US011853009B2

(12) United States Patent
Conti et al.

(10) Patent No.: US 11,853,009 B2
(45) Date of Patent: Dec. 26, 2023

(54) WATCH INTERACTION SIMULATION SYSTEM, APPARATUS, METHOD AND COMPUTER PROGRAM PRODUCT

(71) Applicant: Force Dimension Technologies Sarl, Nyon (CH)

(72) Inventors: Francois Conti, Aubonne (CH); Sébastien Grange, Lausanne (CH); Patrick Helmer, Bernex (CH); Patrice Rouiller, Trélex (CH); Tiavina Niaritsiry, Le Sentier (CH); Luc Maillat, Chavornay (CH)

(73) Assignee: Force Dimension Technologies Sarl, Nyon (CH)

( * ) Notice: Subject to any disclaimer, the term of this patent is extended or adjusted under 35 U.S.C. 154(b) by 303 days.

(21) Appl. No.: 17/058,816

(22) PCT Filed: May 27, 2019

(86) PCT No.: PCT/EP2019/063699
§ 371 (c)(1),
(2) Date: Nov. 25, 2020

(87) PCT Pub. No.: WO2019/224403
PCT Pub. Date: Nov. 28, 2019

(65) Prior Publication Data

US 2021/0208540 A1 Jul. 8, 2021

(30) Foreign Application Priority Data

May 25, 2018 (EP) ..... 18174447

(51) Int. Cl.
*G04B 25/02* (2006.01)
*G04B 3/00* (2006.01)
(Continued)

(52) U.S. Cl.
CPC ..... *G04B 25/02* (2013.01); *G04B 3/006* (2013.01); *G04B 3/041* (2013.01); *G04C 3/001* (2013.01)

(58) Field of Classification Search
CPC ..... G04B 3/0006; G04B 37/10; G04B 41/00; G04B 3/02; G04B 37/1426; G04B 3/04;
(Continued)

(56) References Cited

U.S. PATENT DOCUMENTS 4,291,843 A 9/1981 Yanagawa et al.
10,935,932 B2 * 3/2021 Mace ..... G04B 37/10
(Continued)

FOREIGN PATENT DOCUMENTS

EP 0392980 A1 6/1993
EP 1220061 A1 7/2002
(Continued)

OTHER PUBLICATIONS

International Search Report and Written Opinion dated Sep. 19, 2019 for International Application No. PCT/EP2019/063699, 9 pages.

*Primary Examiner* — Edwin A. Leon
(74) *Attorney, Agent, or Firm* — Frost Brown Todd LLP

(57) ABSTRACT

A watch interaction simulation apparatus for carrying out interaction with a watch interaction member for a watch includes a sensor device adapted to be coupled with the watch interaction member. The sensor device is operable to sense an interaction with the watch interaction member. The apparatus includes an actuator device being coupled to the watch interaction member, an actuator control device for controlling the actuator device, and a sensor information computing device being operatively coupled to the sensor device.

14 Claims, 13 Drawing Sheets

Figure 1:
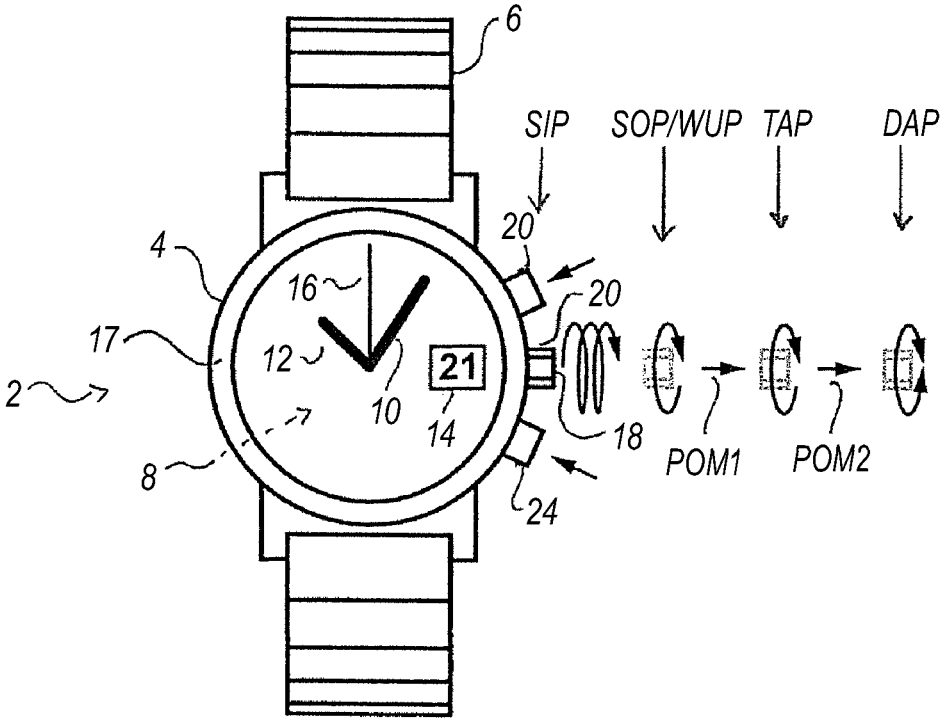

(51) Int. Cl.
*G04B 3/04* (2006.01)
*G04C 3/00* (2006.01)

(58) Field of Classification Search
CPC ..... G04B 37/14; G04B 3/00; G04B 37/081; G04B 3/08; G04D 7/009
See application file for complete search history.

(56) References Cited

U.S. PATENT DOCUMENTS

| | | | | |
|---|---|---|---|---|
| 11,144,013 | B2 * | 10/2021 | Buehler | G04D 7/009 |
| 2006/0018199 | A1 | 1/2006 | Louie | |
| 2009/0294320 | A1 | 12/2009 | Wolf et al. | |

FOREIGN PATENT DOCUMENTS

| | | | |
|---|---|---|---|
| EP | 1288744 | | 3/2003 |
| EP | 3803515 | A1 | 4/2021 |
| WO | WO 2018/031203 | | 2/2018 |
| WO | WO 2019/224403 | | 11/2019 |

* cited by examiner

WATCH INTERACTION SIMULATION SYSTEM, APPARATUS, METHOD AND COMPUTER PROGRAM PRODUCT

FIELD

The present disclosure generally relates to watches and, particularly, to systems, apparatuses and methods as well as computer program products for simulation and/or evaluation of an operation of a watch as regards user interaction.

BACKGROUND

In order to assist watch makers during the design of a new watch, e.g., computer aided design, simulation of rigid body mechanics and finite element models as well as rapid prototyping techniques to print physical parts in 3D are used.

This also includes the design of parts of a watch that are to be manipulated by its users, for example the winding crown for winding up a mechanical movement and adjusting time and date and pushers for (de)activating watch hands of a chronometer to start/stop timing.

However, in order to ascertain whether a watch design meets requirements and expectations with respect to its practical handling by user, it is necessary to actually build the watch (e.g. in form of a prototype) and, then, to test it. This is a cost and time consuming iterative process, which often involves to dismiss a watch design and to start, more or less, from the beginning all over again. Further, such testing relies on user-dependent assessment concerning the handling of a watch and, particularly, those parts that can be manipulated by a user.

Object

In order to facilitate the design process of watches, an object of the present disclosure is to provide solutions making the design process of watches easier, more reliable and less cost and time consuming as well as providing an objective basis for an evaluation of the handling of a watch and, particularly, those parts that can be manipulated by a user.

SUMMARY

In view of the foregoing, the present disclosure provides subject-matter according to the independent claims, wherein preferred variations, embodiments, examples etc. are defined in dependent claims.

Generally, the following can be said: The present disclosure allows a user to interact with at least one watch interaction member for a watch, wherein the behavior of the watch interaction member is controlled, for example, to mimic the behavior of a real watch (e.g. to evaluate the handling qualities of a watch) or to test a new behavior and handling qualities, respectively, for a watch that have not been put into practice before.

Possible applications of the present disclosure include, without being limited thereto, for example:

- The specification phase of a watch, where the behavior of the watch interaction members is defined.
- The industrial design phase where the geometry, shapes and materials are elaborated.
- The development phase where the desired behavior may have to be adjusted to consider geometrical and physical design constraints.

- The industrialization phase where manufacturing tolerances have to be defined and their effect on usability evaluated.
- The product validation phase where extensive user studies are conducted.
- The marketing and sales activities where such a simulator could materialize a watch that is not physically present or that offers some customization possibilities to the buyer.

The present disclosure may be considered to provide a "missing link" between quantitative technical (e.g. structural, mechanical) properties of a watch with respect to its interaction behavior and the qualitative human perception (e.g. haptic, tactile, ergonomic) of the technical watch manipulation properties.

Interaction with a watch interaction member requires force and/or torque applied thereon. The relationship between, on the one hand, force and/or torque applied to a watch interaction member and, on the other hand, displacement, movement, rotation etc. of the watch interaction member is usually not constant and irregular at the watch interaction member—at least in the perception of a user. This is essentially given by the coupling (e.g. mechanical transmission and/or bearing) of the watch interaction member with the watch (e.g. the watch housing) and/or internal watch components (e.g. watch movement or sensor arrangement in electronic watches). For example, a watch interaction member can have several behaviors like static and dynamic friction, end-stops, force thresholds (or peaks) and force dips, spring forces, asymmetric ratcheted behaviors or mechanical play.

In addition, the interface between a user, particularly its finger(s) and/or hand, and a watch interaction member as well as the surrounding watch housing, watch bracelet and the user's arm wearing the watch all play a role in the ease of manipulation, the sensory feedback and the avoidance of high pressure regions on the user's hands. The geometry (e.g. shape and size) and material (e.g. stiffness, surface finish and thermal properties) of the watch interaction member need careful attention. As an example, for a given force exerted on a watch interaction member, the perceived pressure on the fingertip can be small or large depending on the large or small size of the button that the user is manipulating.

SHORT DESCRIPTION OF THE DRAWINGS

Figure 2:
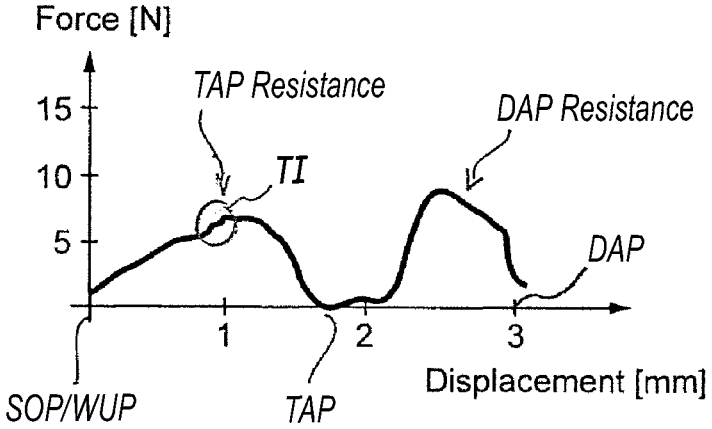
Figure 3A:
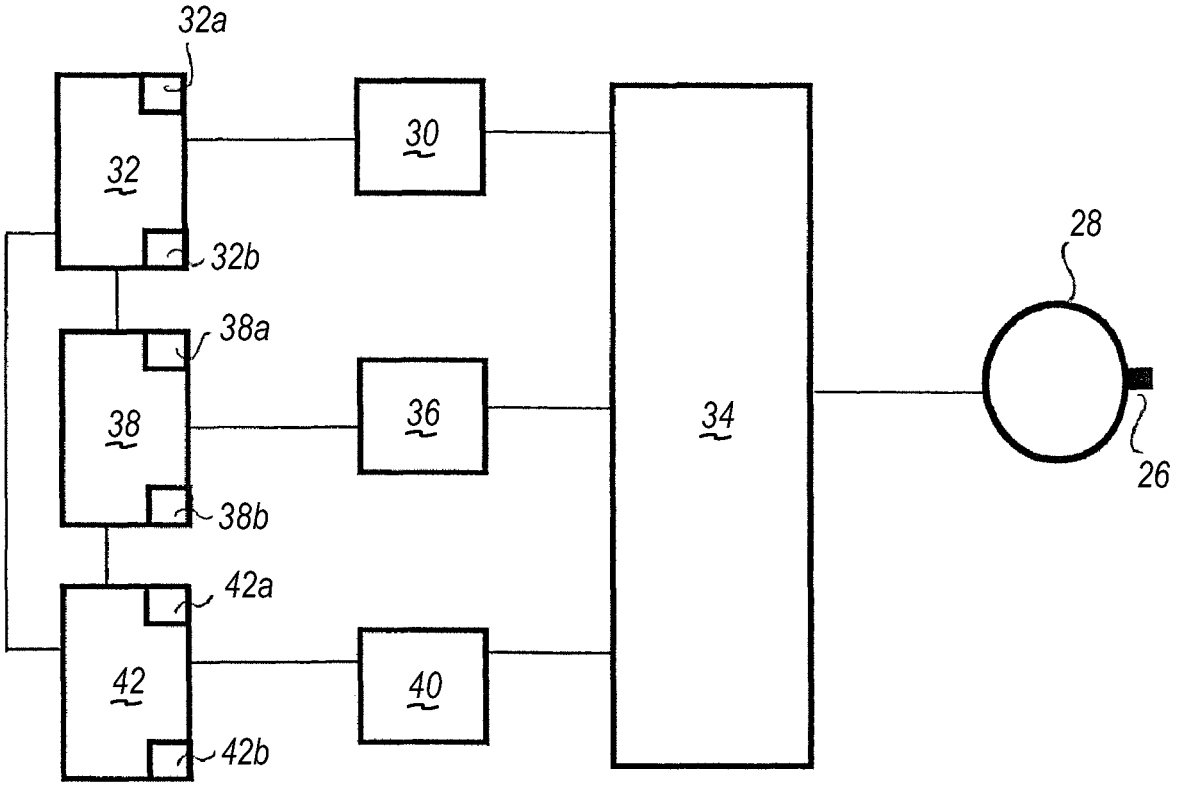
Figure 3B:
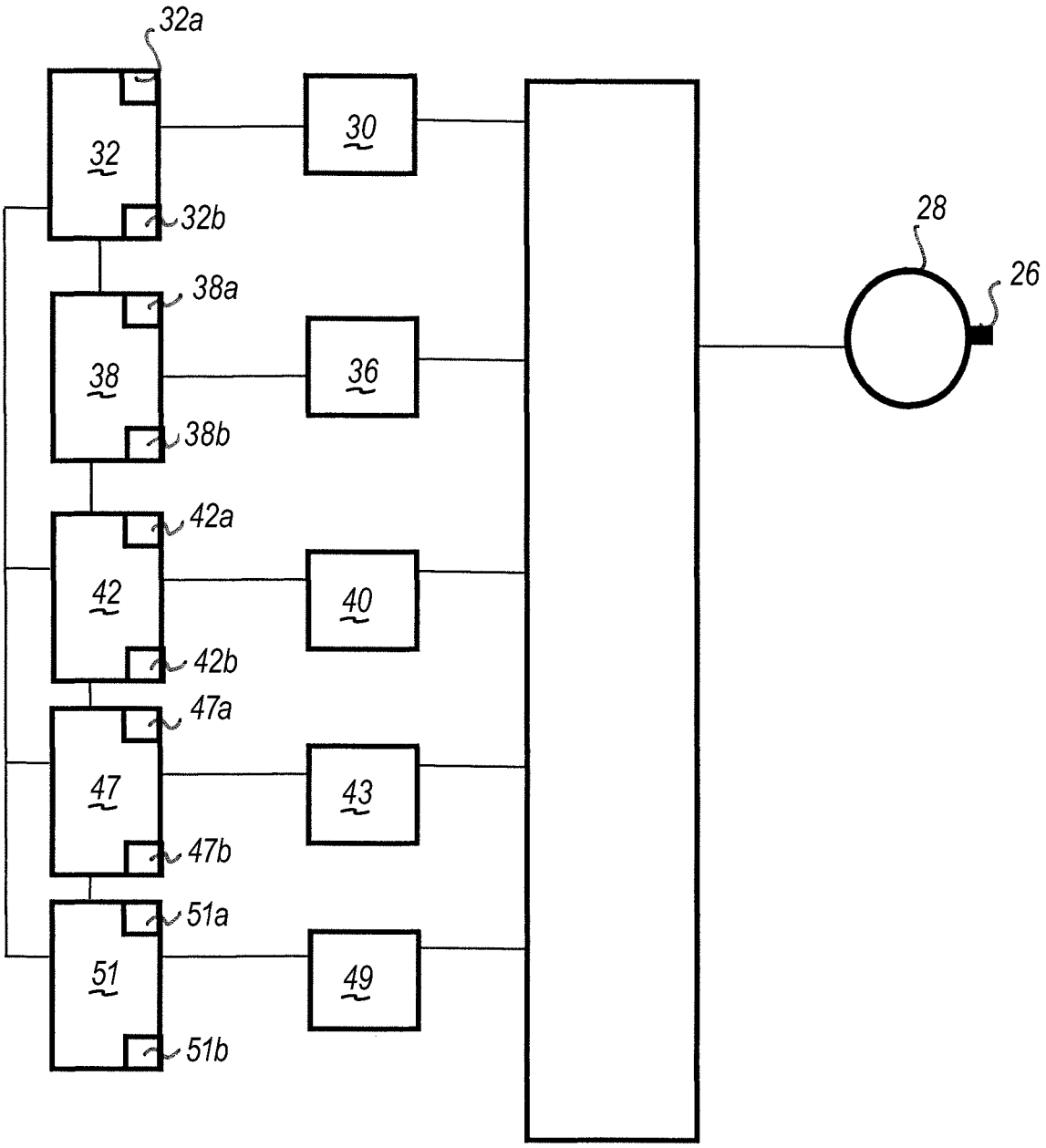
Figure 4A:
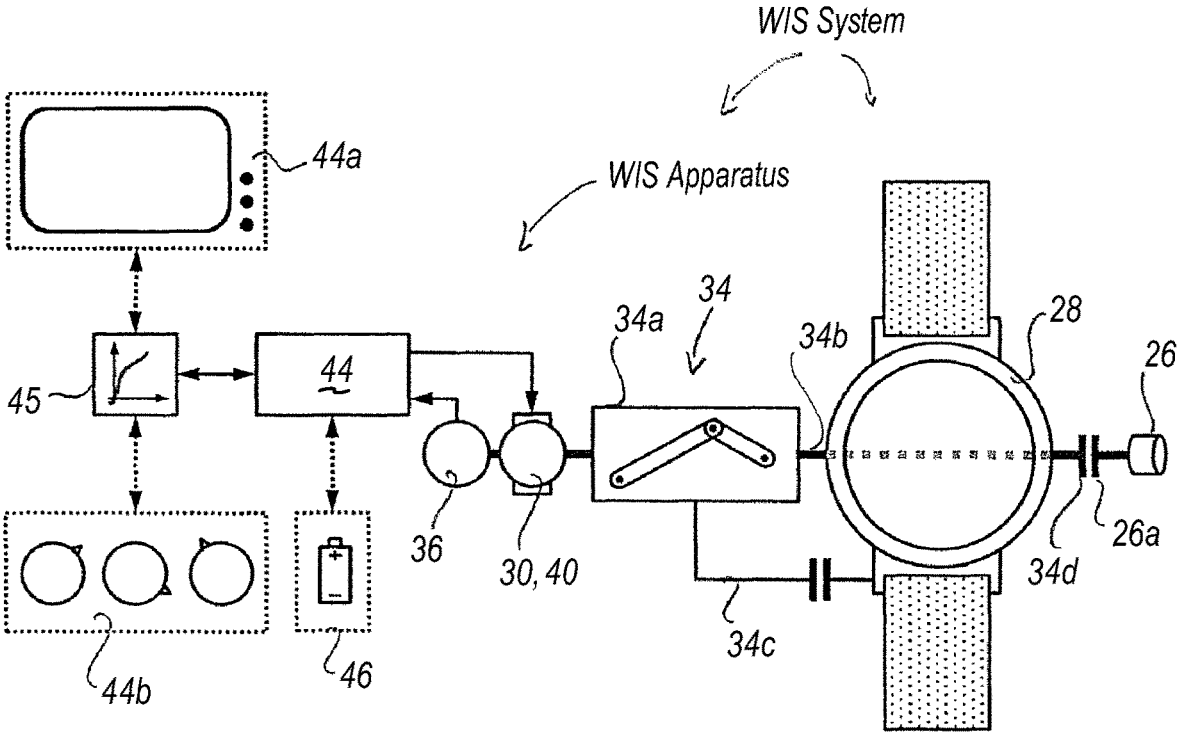
Figure 4B:
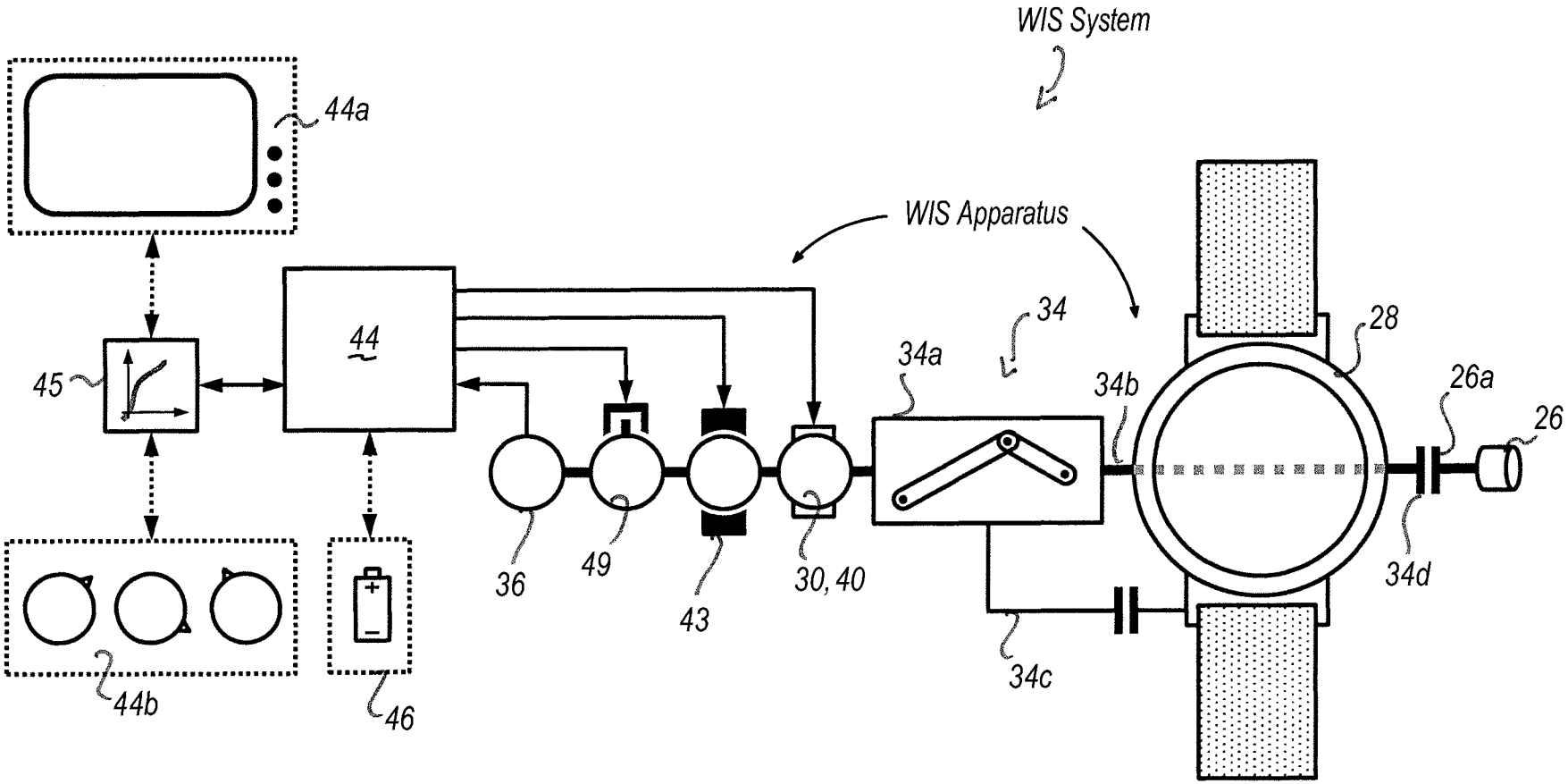
Figure 4C:
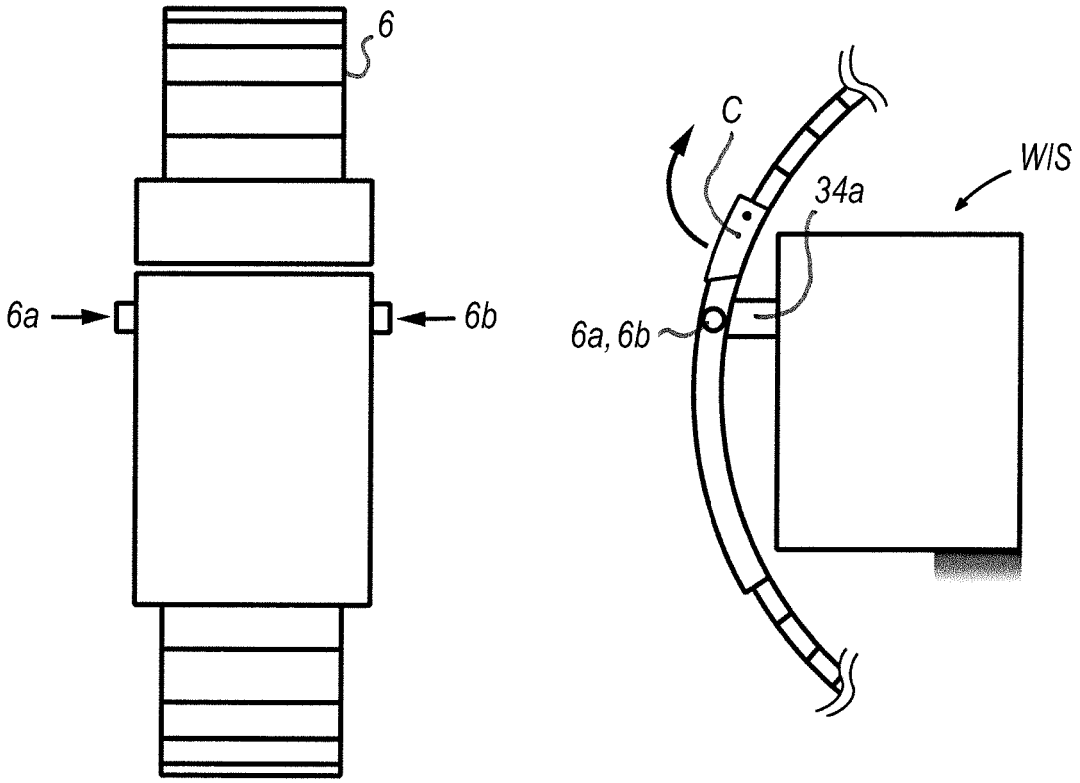
Figure 5A:
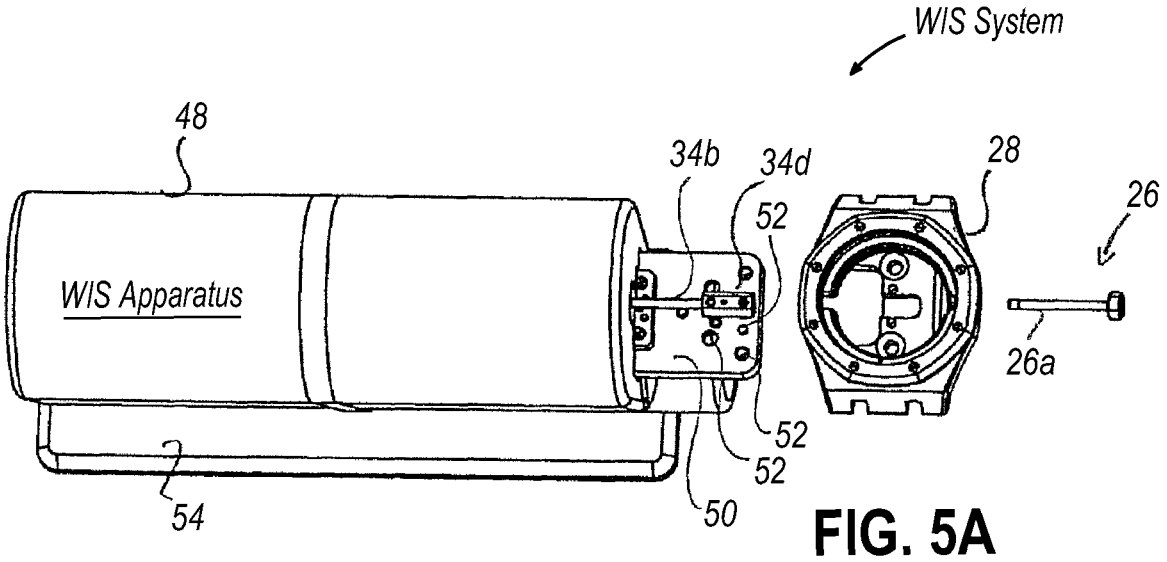
Figure 5B:
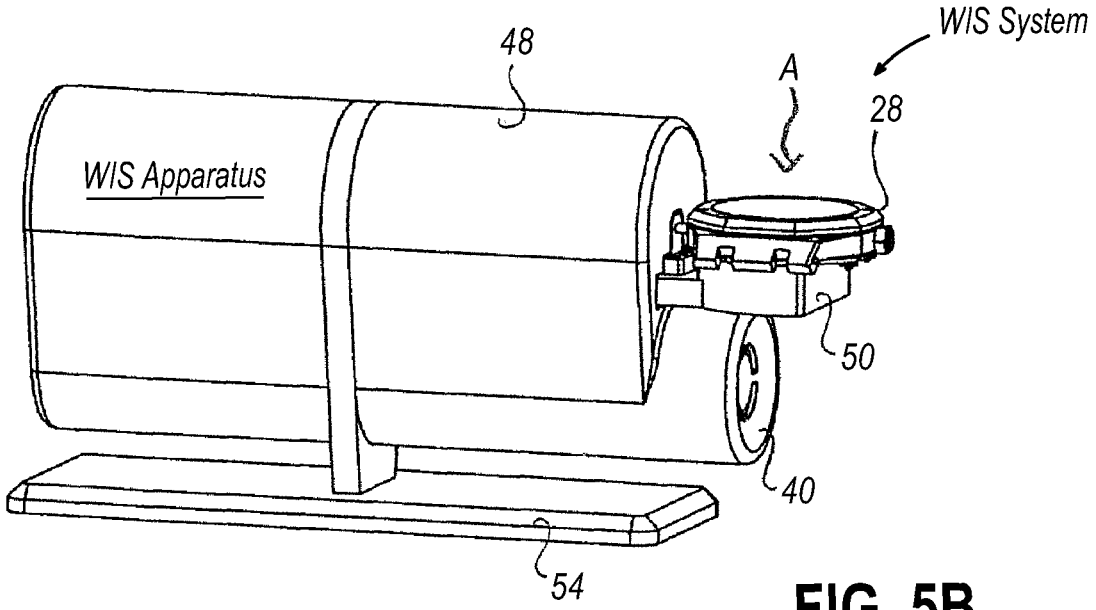
Figure 6:
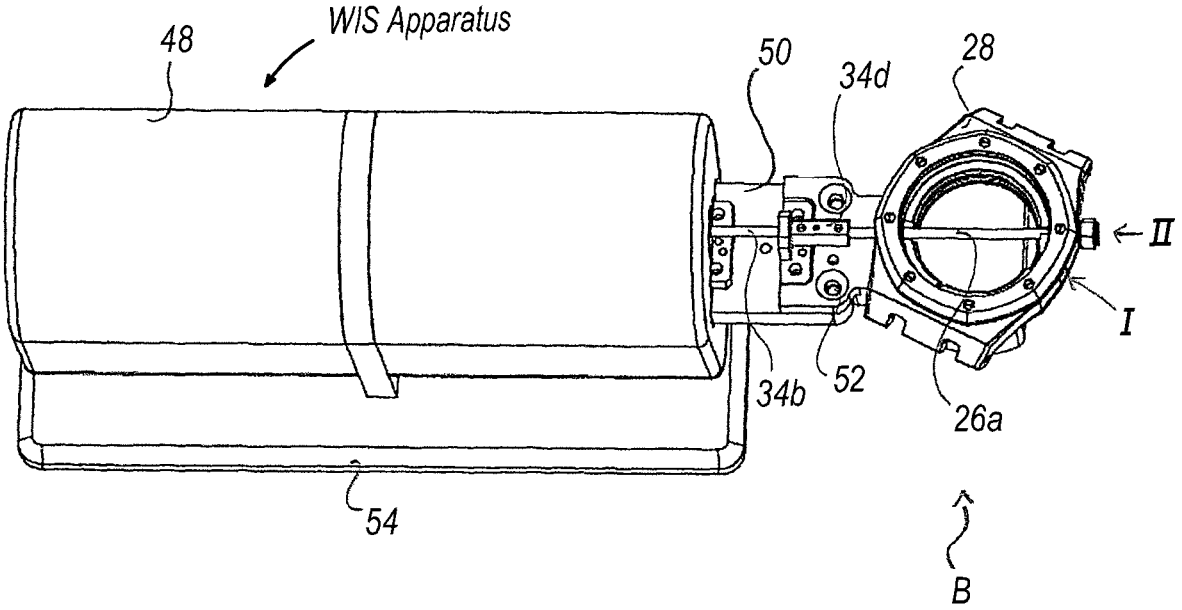
Figure 7:
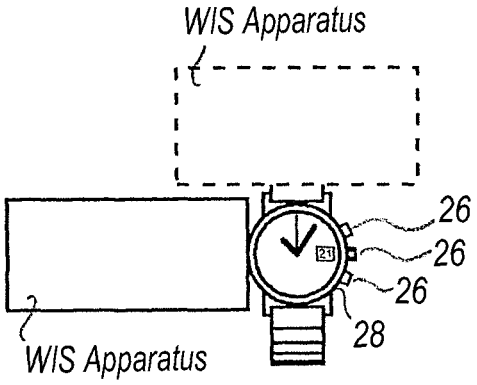
Figure 8A:
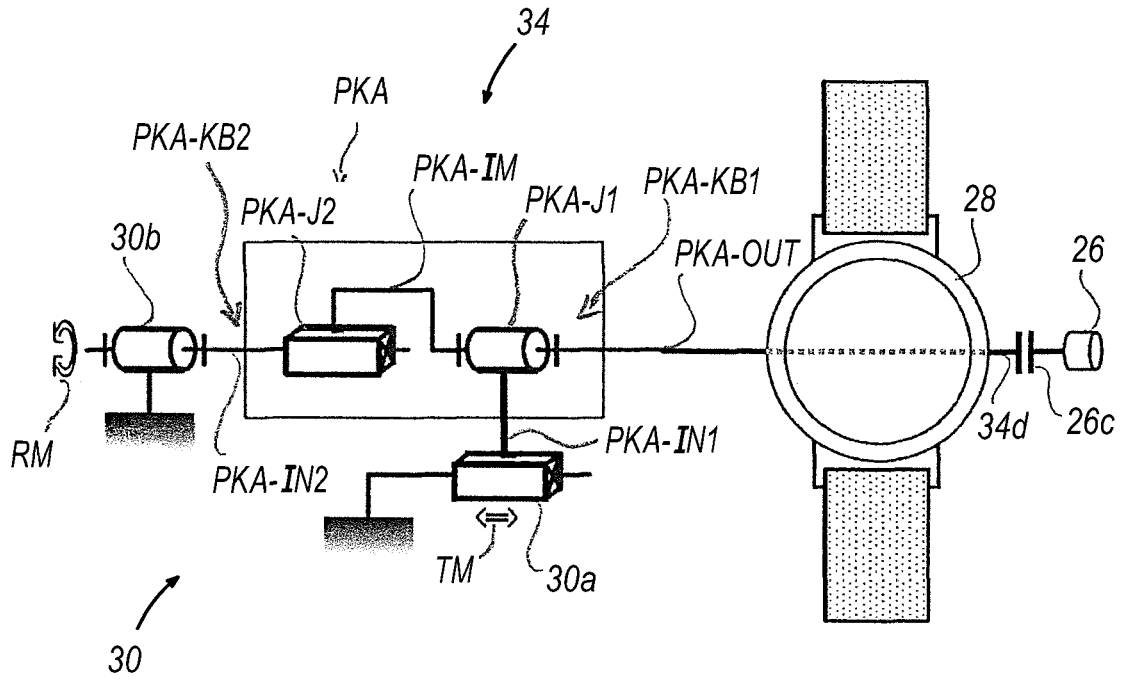
Figure 8B:
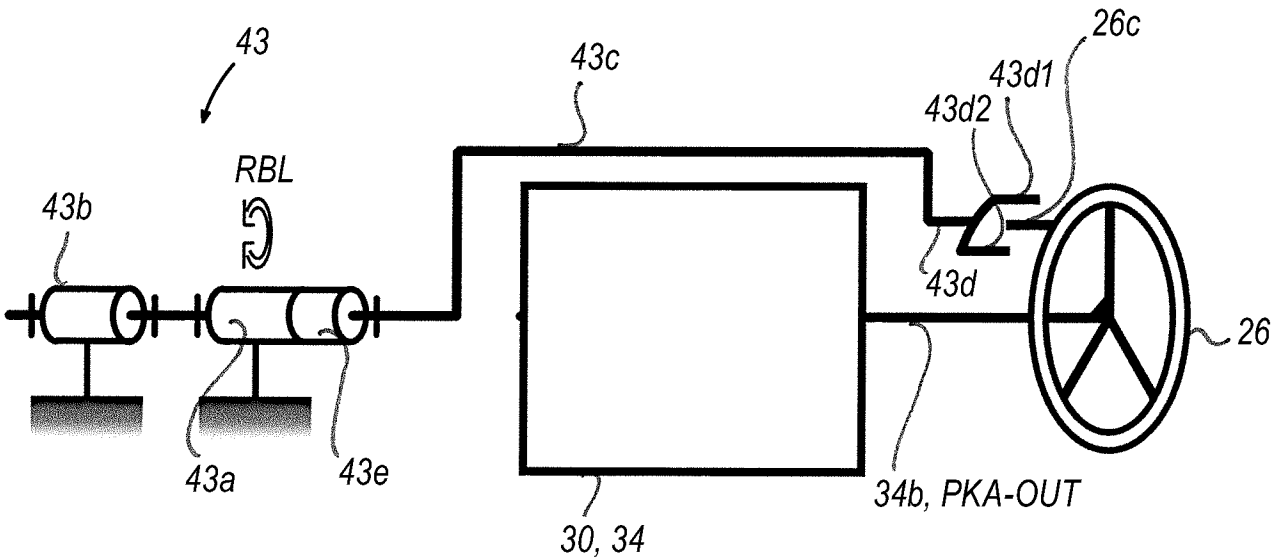
Figure 8C:
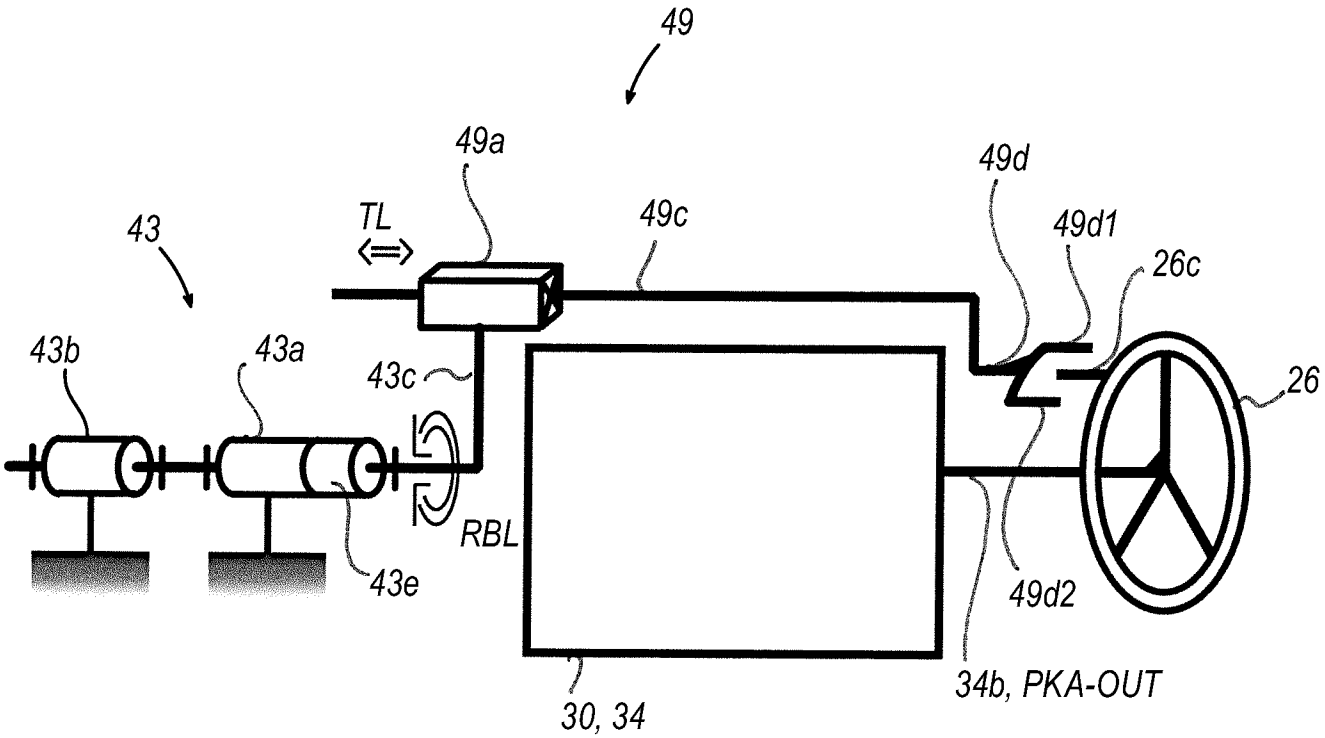
Figure 9:
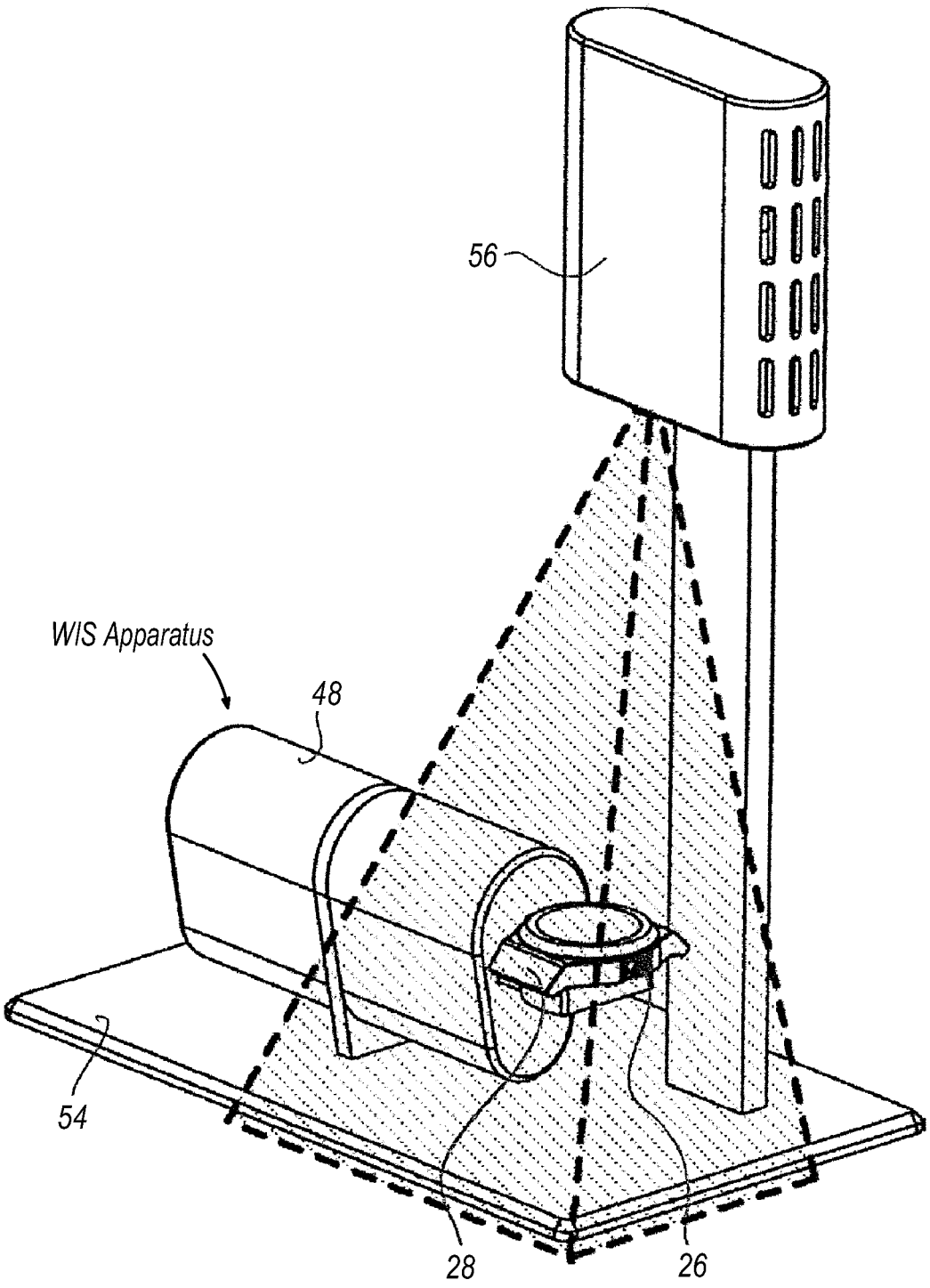
Figure 10:
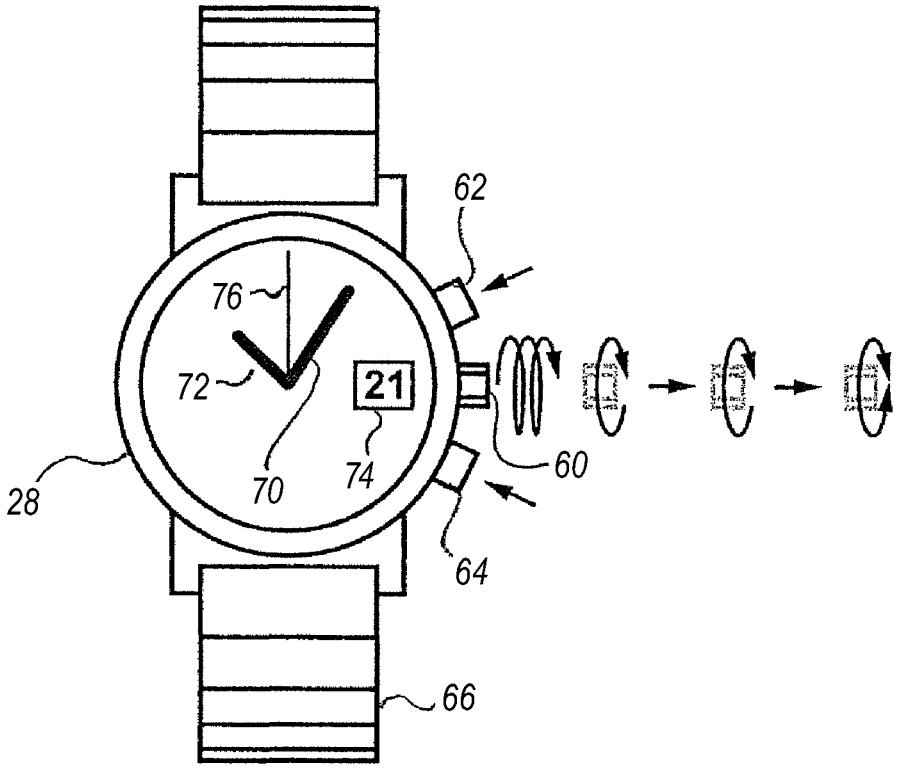

Examples of the present disclosure will now be described, by way of example, and with reference to the accompanying drawings, in which:

FIG. 1 illustrates a watch having exemplary watch interaction members,

FIG. 2 illustrates displacements of a watch interaction member and related forces, FIG. 3A illustrates an example of a Watch Interaction Simulation (WIS) system and WIS apparatus, FIG. 3B illustrates an example of a Watch Interaction Simulation (WIS) system and WIS apparatus including a breaking device and/or a locking device, FIG. 4A illustrates a further example of a WIS system and WIS apparatus, FIG. 4B illustrates a further example of a WIS system and WIS apparatus including a breaking device and/or a locking device, FIG. 4C illustrates a example of a WIS system and WIS apparatus including a bracelet (or watchstrap) of a watch having a watch interaction member in form of a push button or a pivotable clasp for releasing/locking a catch;

FIGS. 5A and 5B illustrate a further example of a WIS system and WIS apparatus, FIG. 6 illustrates a further example of a WIS system, FIG. 7 illustrations positions of an WIS apparatus in relation to a watch interaction member support, FIG. 8A illustrates an example WIS apparatus comprising a transmission device including a parallel kinematics arrangement, FIG. 8B illustrates an example WIS apparatus comprising a transmission device including a parallel kinematics arrangement and breaking device and/or locking device operating rotationally, FIG. 8C illustrates an example WIS apparatus comprising a transmission device including a parallel kinematics arrangement and breaking device and/or locking device operating rotationally and/or translationally, FIG. 9 illustrates an example of a WIS system and WIS apparatus including an imaging system, FIG. 10 illustrates an exemplary watch interaction member support and watch interaction members.

DETAILED DESCRIPTION

The design of a watch is challenging not only in technical respect, but also with a view on its use. In the latter respect, one has to consider not only general/objective ergonomic aspects, but also subjective user-dependent ergonomic aspects, which include—in not a few cases—very subjective, user-dependent wishes and preferences.

In order to take into account general/objective ergonomic aspects, for example empirical experience from former watch designs, feedback from users, scientific studies can be used as basis.

For example, a general/objective ergonomic aspect is a location of the winding crown of a watch on the watch housing. If the watch is worn on the left wrist, it is easier to manipulate the winding crown of the watch if the winding crown is located on the right-hand side of the watch housing. If the watch is worn on the right wrist, it is easier to manipulate the winding crown of the watch if the winding crown is located on the left-hand side of the watch housing.

It would be also advisable to take into account subjective, user-dependent wishes and preferences in the design of a watch.

Following the above example of the winding crown location, it can be assumed that users wearing watches on the left wrist will favor winding crowns on the right-hand side of the watch housing. However, there may be significant differences between users with respect to where the location of the winding crown on the right housing side is preferred (e.g. at 3 o'clock as in most watches or more towards 6 o'clock in, e.g., diving watches) or how much force is necessary to manipulate the winding crown (e.g. for unwinding a screwed-down winding crown, rotation of a winding crown, or to wind-up a winding of a mechanical watch movement).

Evaluation of whether the watch design actually meets objective and subjective ergonomic aspects can be accomplished by iterative trial-and-error processes where often many physical prototypes in various stages of completeness and functionality are built and evaluated for specific characteristics until the watch feels as desired. In other words, such processes can be considered as tests of real watches.

The following describes examples allowing to simulate and test various designs for a watch, particularly with respect to parts of a watch provided for manipulation by and interaction with a user (in the following shortly interaction).

A part of a watch provided for manipulation by and interaction with a user may allow the user to control the watch and/or provide input to the watch, for example, if the users pushes, rotates, shifts, touches a respective part of the watch. Also, or as alternative, a part of a watch provided for interaction with a user may allow the watch to provide output to the user, e.g. in form of force feedback, visual information, acoustic information, thermal information, tactile information and the like.

Hence, in terms of the present disclosure, a part of a watch provided for interaction with a user can be considered an input and/or output device. Therefore, a part of a watch provided for interaction with a user is referred to as watch interaction member, hereinafter.

Apart from the above-mentioned winding crown, a watch interaction member allowing a user to control a watch and/or provide input thereto can be, for example, without limitation thereto:

- A pusher for, e.g., activation and/or deactivation of a watch function (e.g. to start and/or stop a movement of a sweep second hand of a watch having chronometer or stop-watch functionalities; reset and/or set of a watch hand).
- A lever for, e.g., starting and/or stopping a watch function, shifting to and/or between operational modes of a watch (winter/summer time).
- A watch glass or areas thereof being touch sensitive, wherein touching the watch glass (areas) electrically and/or electronically activates and/or deactivates a watch function.
- A watch glass or areas thereof being moveably supported, wherein a movement of the watch glass (area) mechanically and/or electrically activates and/or deactivates a watch function.
- A hand of a watch (e.g. in a watch for blind users or users with impaired vision), where, for example, the hand can be moved by the user to adjust the time.
- A bezel of a watch, wherein a user can rotate the bezel with respect to the watch housing.
- A bracelet (often also referred to as watchstrap) of a watch (often also referred to as watchstrap), where a user can interact with an interaction member, for example in form of a push and/or slider button or other moveable parts (e.g. pivotably moveable as for example a clasp), which may be operated in order, e.g., to lock or unlock a mechanism or catch that generally allows to unfold additional links or to release links to enlarge the bracelet diameter for passing the hand.

A watch interaction member allowing a watch to provide output to the user can be, for example, without limitation thereto:

- A winding crown, pusher, lever, watch glass (or any other watch interaction member allowing a user to control a watch and/or provide input thereto) providing force feedback to the user (e.g. in form of resistance of a winding crown, pusher, lever, watch glass against being rotated, pushed, displaced by a user, by vibration of a part of watch).
- Any part of a watch being adapted to provide and/or output visual information, e.g. a hand, a date indicator, a display.
- Any part of a watch being adapted to provide and/or output acoustic information, e.g. a loudspeaker or a part acting like a loudspeaker (e.g. a moveable surface).
- Any part of a watch being adapted to provide and/or output thermal information, e.g. by controlling the temperature of part of a watch housing to provide, e.g. for a blind user or users with impaired vision, information on temperature.

Any part of a watch being adapted to provide and/or output tactile information, e.g. a hand of a watch for blind users or users with impaired vision, wherein the touch of the watch hand allows determination of the time, or a device of a watch acting like a so-called refreshable braille display or braille terminal (Explanation: A refreshable braille display or braille terminal is an electro-mechanical device for displaying braille characters, wherein round-tipped pins raised through holes in a flat surface; often used as output device in connection with computers).

Any part of a watch being adapted to provide input and/or output

In the following, reference will be made now, only for illustration purposes and not limiting in any respect, to watch interaction members in the form of a winding crown and pushers.

FIG. 1 illustrates an exemplary watch 2 comprising a watch housing 4 and bracelet (watchstrap) 6. The watch housing 4 accommodates a movement 8, which controls a big watch hand (also referred to as hour watch hand) 10 and a small watch hand (also referred to as minute watch hand) 12. The watch 2 may also comprise a calendar work (also referred to as date display) 14, which may indicate the date, as shown, by a number of the respective day or, in other examples, additionally by displaying the respective month. The calendar work 14 is also controlled by the movement 8. The watch 2 may comprise a sweep second hand 16 (i.e. a hand providing a stop-watch function of the watch 2), also controlled by the movement 8. The watch may comprise a bezel 17.

The watch 2 comprises a winding crown 18. The winding crown 18 may be used to adjust the positions of the at least one of the hour watch hand 10 and the minute watch hand 12 and the time setting of the watch 2, respectively. In the case the watch 2 has a calendar work 14, the winding crown 18 may be used to adjust the calendar work 14 and the displayed day/date, respectively.

The circumferential surface of the winding crown 18 may be structured, e.g., to exhibit a facet 20 or the like (in the following collectively referred to as facet). The facet 20 promotes friction between the finger(s) of a user and the winding crown 18.

In the case the watch 2 has a mechanical movement 8, the winding crown 18 can be used to windup a spring (usually a main spring) of the mechanical movement (shortly, to windup the movement). In the case the watch 2 has an electrically driven movement 8 (also referred to as digital movement), no winding up is necessary and, thus, the winding crown 18 is not required to allow winding up the watch 2; nevertheless, the term "winding crown" is used for such watches as well.

The winding crown 18 has a position SIP (screwed in position), in which the winding crown 18 is screwed into the watch housing 4 by means of an outer thread formed at an outer surface of the winding crown 18 and an inner thread formed at an outer surface of an opening/bore in the housing 4. In the SIP position, the winding crown 18 is secured against operation thereof to adjust the hand(s) 10/12 and timing, respectively, to adjust the calendar work 14 and the day/date, respectively, and, if applicable, to wind up the movement 8.

The winding crown 18 has a position SOP (screwed out position), in which the winding crown 18 is screwed out of the watch housing 4, which is indicated by the spirally formed arrow SR (screw rotation), so that the threads being engaged in the SIP position are brought out of engagement. In order to return the winding crown 18 into the SIP position, the winding crown 18 is screwed into the watch housing 4 by a rotation of movement opposite to that of the arrow SR.

In some examples, the winding crown 18 may be biased by a spring located in the watch housing. When the winding crown 18 is screwed out from the SIP position into the SOP position, upon termination of the engagement of said threads, the force of the biasing spring can act on the winding crown 18 in manner perceivable by a user. For example, the biasing spring can be adapted such that, upon termination of the engagement of said threads, it automatically moves the winding crown 18 at little bit further and into the SOP position. In such examples, the user may perceive a small "jerk" of the winding crown 18.

In the illustrated example, the SAP position corresponds with a position WUP (winding up position) of the winding crown 18, in which the winding crown 18 can be rotated to windup the movement 8. In further examples, the SAP and WUP positions differ and the winding crown 18 has to be moved (pulled out) from the SAP position to the (according to FIG. 1) right to be moved into the WUP position.

The force and/or torque necessary for and perceived by a user for bringing the winding crown 18 in the SOP position depend, for example, from friction acting on the winding crown 18 (e.g. due to friction of said threads). Also, if applicable, the friction between the finger(s) of a user applied for interacting with the winding crown 18 due to the facet 20 influences the necessary and perceived force and/or torque. Also, the shape of the winding crown 18 (e.g. diameter and/or length of the winding crown) may influence the force and/or torque necessary for and perceived by a user for bringing the winding crown 18 in the SOP position. A further parameter in this respect may be, if applicable, the force of the biasing spring acting towards the SOP position.

In a comparable way, the force and/or torque necessary for and perceived by a user for bringing the winding crown 18 into the SIP position depend, for example, from friction acting on the winding crown 18 (e.g. due to friction of said threads). Again, if applicable, the friction between the finger(s) of a user applied for interacting with the winding crown 18 due to the facet 20 influences the necessary and perceived force and/or torque. Also, the shape of the winding crown 18 (e.g. diameter and/or length of the winding crown) may influence the force and/or torque necessary for and perceived by a user for bringing the winding crown 18 in the SIP position. Also, a parameter in this respect may be, if applicable, the force of the biasing spring acting towards the SOP position. Here, it has to be noted that it may require more or less force and/or torque from the user to act against the biasing as compared to force and/or torque from the user for bringing the winding crown 18 into the SOP position.

Therefore, depending on the force and/or torque necessary for and perceived by user for an interaction to bring the winding crown 18 in the SOP position, the user may perceive it easier or more difficult to bring the winding crown 18 in the SOP position than in the SIP position.

The other way around, depending on the necessary force and/or torque necessary for and perceived by user for an interaction to bring the winding crown 18 in the SIP position, the user may perceive it easier or more difficult the bring the winding crown 18 in the SIP position than in the SOP position In the WUP position, the winding crown 18 may be used to wind up the movement. The force and/or torque a user has to apply to the winding crown 18 for a winding-up interaction, may depend, for example, from the resistance of a main spring of the movement 8 and/or the (mechanical) coupling of the winding crown 18 with the movement 8. Again, the facet 20 (if being present) and/or the shape of the winding crown 18 (e.g. diameter and/or length of the winding crown) may influence the force and/or torque necessary for and perceived by a user for a wind-up interaction.

Depending on the force and/or torque necessary for and perceived by user for a winding-up interaction, a user may perceive it easier or more difficult to wind up the watch 2.

The winding crown 18 may be movable, as indicated by arrow POM1 (pull out movement 1), to be moved from the WUP position into a position TAP (time adjustment position). The force necessary for and perceived by a user for such a movement may depend from the coupling of winding crown 18 with internal components of the watch 2. Also, the facet 20 (if being present) and/or the shape of the winding crown 18 (e.g. diameter and/or length of the winding crown) may influence the force and/or torque for an interaction to bring the winding crown 18 in the TAP position.

Depending on the force and/or torque necessary for and perceived by user for an interaction to bring the winding crown 18 in the TAP position, the user may perceive it easier or more difficult to bring the winding crown 18 in the TAP position.

In order to indicate to a user that the TAP position is reached, the coupling of the winding crown 18 may be such that the user experiences a (small) resistance against a further movement of the winding crown 18 in the direction of the arrow POM1. Such a resistance will be also referred to as TAP resistance.

Depending on the implemented resistance, the user may perceive a stronger or weaker "signal" (or force feedback) indicating that the TAP position is reached.

In the TAP position, the winding crown 18 may be rotated to adjust the position of at least one the hour watch hand 10 and the minute watch hand 10 and, thereby, the time the watch displays.

The force and/or torque a user has to apply to the winding crown 18 for a time-adjustment interaction, may depend, for example, from the resistance of a main spring of the movement 8 and/or the (mechanical) coupling of the winding crown 18 with the movement 8. Also, the facet 20 (if being present) and/or the shape of the winding crown 18 (e.g. diameter and/or length of the winding crown) may influence the force and/or torque for a time-adjustment interaction.

Depending on the force and/or torque necessary for and perceived by user for a time-adjustment interaction, a user may perceive it easier or more difficult to adjust the time of the watch 2.

The winding crown 18 may be movable, as indicated by arrow POM2 (pull out movement 2), to be moved from the TAP position into a position DAP (day/date adjustment position). The force necessary for and perceived by a user for such a movement may depend from the coupling of winding crown 18 with internal components of the watch 2. A further parameter may be, if applicable, the above TAP resistance acting against a movement of the winding crown 18 in the direction of the arrows POM 1 and POM2, respectively. A larger TAP resistance will require a higher force than a smaller TAP resistance. Also, the facet 20 (if being present) and/or the shape of the winding crown 18 (e.g. diameter and/or length of the winding crown) may influence the force and/or torque for an interaction bringing the winding crown 18 in the DAP position.

Depending on the force and/or torque necessary for and perceived by user for an interaction to bring the winding crown 18 in the DAP position, the user may perceive it easier or more difficult to bring the winding crown 18 in the DAP position.

In the DAP position, the winding crown 18 may be rotated to adjust the calendar work 14 and, thereby, the day/date the watch displays.

The force and/or torque a user has to apply to the winding crown 18 for the day/date-adjustment interaction, may depend, for example, from the resistance of a main spring of the movement 8 and/or the (mechanical) coupling of the winding crown 18 with the movement 8. Again, the facet 20 (if being present) and/or the shape of the winding crown 18 (e.g. diameter and/or length of the winding crown) may influence the force and/or torque necessary for and perceived by a user for a day/date-adjustment interaction.

Depending on the force and/or torque necessary for and perceived by user for a day/date-adjustment interaction, a user may perceive it easier or more difficult to adjust the day/date of the watch 2.

Please note, the force and/or torque for a winding-up interaction and/or the force and/or torque for a time-adjustment interaction and/or the force and/or torque for a day/date-adjustment interaction may differ, may be comparable or may be essentially the same.

The watch 2 may comprise a start pusher 22 and a stop pusher 24. In other examples, a pusher integrally providing the functions of the start pusher 22 and the stop pusher 24 may be used.

Interaction of a user with the start pusher 22 can be used to control the movement 8 so that the sweep second hand starts moving (in the following start-interaction). Interaction of a user with the stop pusher 22 can be used to control the movement 8 so that the sweep second hand stops moving (in the following stop-interaction). Then, for example, a further interaction of a user with the start pusher 22 can be used to control the movement 8 so that the sweep second hand starts moving again (in the following restart-interaction), or further interaction a user with the stop pusher 22 can be used to control the movement 8 so that the sweep second hand is moved back in its initial position shown in FIG. 1 (in the following reset-interaction).

The force necessary for and perceived by a user for a start-interaction may depend from the coupling of the start pusher 22 and the movement 8. Depending on the force necessary for and perceived by user for a start-interaction, a user may perceive it easier or more difficult to start the stop-watch function of the watch 2.

The force necessary for and perceived by a user for a stop-interaction may depend from the coupling of the stop pusher 24 and the movement 8. Depending on the force necessary for and perceived by user for a stop-interaction, a user may perceive it easier or more difficult to stop the stop-watch function of the watch 2.

The force necessary for and perceived by a user for a restart-interaction may depend from the coupling of the start pusher 22 and the movement 8. Depending on the force necessary for and perceived by user for a restart-interaction, a user may perceive it easier or more difficult to restart the stop-watch function of the watch 2.

The force necessary for and perceived by a user for a reset-interaction may depend from the coupling of the stop pusher 24 and the movement 8. Depending on the force necessary for and perceived by user for a reset-interaction, a user may perceive it easier or more difficult to reset the stop-watch function of the watch 2.

Please note that the force for a start-interaction and/or the force for a stop-interaction and/or the force for a restart-interaction and/or the force for a reset-interaction may differ, may be comparable or may be essentially the same.

FIG. 2 illustrates an exemplar graph indicating forces applied for moving a winding crown from the SOP/WUP position to the TAP position and from the TAP position to the DAP position. Starting in the SOP/WUP position, the user has to apply an increasing force until the highest point of the bell-shaped curve PI is reached, approximately half way towards the TAP position. At the PI position, a user perceives the TAP resistance. If the user increases the force (s. FIG. 2: force step FI) to overcome the TAP resistance, the winding crown starts to move out of the P1 position due to the negative stiffness (slope of the curve angled downwards) and towards the TAP resting position. As exemplary illustrated in FIG. 2, the forces applied to overcome the DAP resistance to reach the DAP position may be higher than the TAP resistance and the spacing of the axial locations where the TAP and DAP resistance peaks occur may be designed to be sufficiently large, in order to prevent the winding crown from inadvertently moving from the SOP/WUP position directly to the DAP position without stopping at the intermediate desired TAP resting position.

As described above, the force and/or torque necessary for and perceived by a user for a given interaction with a watch interaction member may depend on various parameters and may differ (or not) from the force and/or torque necessary for and perceived by a user for another interaction with a watch interaction member.

In the design process of a watch, the force and/or torque technically necessary for an interaction with a watch interaction member depends on the technical watch design. However, since watch users are human beings, the way a user perceives may differ significantly between users due to, for example, different dexterity and deftness and subjective, personal expectations on how interaction with a watch should feel like, etc.

FIG. 3A, in more general terms, illustrates a WIS (watch interaction simulation) system or, in other words, a WIS apparatus and an arrangement for simulation of a watch comprising a watch interaction member 26 and a watch interaction member support 28. The latter arrangement can be also referred to as a watch simulation device or a watch mimicking device, because it is used to provide, to a user, the perception of a real watch—at least with respect to the watch interaction member 26. FIG. 4A illustrates, in greater detail but still rather generally, an example of a WIS system and WIS apparatus, respectively.

The watch interaction member 26 is a member that as such, in physical respect, has the properties of a watch interaction member intended for use in an actual watch and, thus, gives a user the perception of a real watch interaction member. As described in the following, the behavior of the watch interaction member 26 is controlled by the WIS apparatus and can be controlled such that the behavior (e.g. as regards force and/or torque necessary for and perceived by a user for interaction with the watch interaction member) is such (or comparable) with the behavior that is intended to be provided by a real watch.

The watch interaction member support 28 can be considered as a device at least mimicking the look and feel of those outer parts of a watch housing that are (likely to be) contacted or interacted with during an interaction with the watch interaction member 26. As illustrated, the watch interaction member support 28 can be an "empty" watch housing indented to be used for a real watch or, in further examples, a structure (e.g. in form of a frame) providing an envelope surface that resembles at least a part of outer surfaces of a watch housing indented to be used for a real watch.

The WIS apparatus comprises at least one actuator device 30 being coupled with the watch interaction member 26. The actuator device 30 is adapted to generate, as actuator device output, at least one of a force, torque, movement onto the watch interaction member 26. The coupling of the actuator device 30 and the watch interaction member 26 is adapted to transmit the actuator device output to the watch interaction member 26.

An exemplary actuator device 30 may comprise at least one of the following:

electrical actuator
magnetic actuator
electro-magnetic actuator
voice coil actuator
moving magnet actuator
piezoelectric actuator
hydraulic actuator
pneumatic actuator
spring loaded actuator
gyroscopic moment actuator An exemplary actuator device 30 may provide at least one of the following actuator device outputs:

a position
a translational movement
a rotational movement
a translational velocity
a rotational velocity
a translational acceleration
a rotational acceleration
a force
a torque The WIS apparatus comprises an actuator control device 32 being adapted to control the actuator device 30. The actuator control device 32 may comprise its own user interface including a display 32*a* device and an input device 32*b*.

The actuator device 30 and the watch interaction member 26 are coupled via a transmission device 34. Particularly, they are coupled such that the actuator device output of the actuator device 30 is transmitted to the watch interaction member 26.

Generally, the transmission device provides to the watch interaction member with respect to the watch interaction member support, at least one translational degree of freedom and/or at least one rotational degree of freedom.

Further generally, the actuator device may include one actuator, if one degree of freedom is to be provided for interaction with the watch interaction member.

For example, in the case of a watch interaction member that can be just pressed or pushed, the actuator device may provide an actuator device output in the form of a translational movement if the transmission device transmits the received actuator device output as translational movement to the watch interaction member. In other alternative cases here, the actuator device may provide an actuator device output in the form of a rotational movement if the transmission device transforms the received actuator device output into translational movement to the watch interaction member.

As further example, in the case of a watch interaction member that can be just rotated, the actuator device may provide an actuator device output in the form of a rotational movement if the transmission device transmits the received actuator device output as rotational movement to the watch interaction member. In other alternative cases here, the actuator device may provide an actuator device output in the form of a translational movement if the transmission device transforms the received actuator device output into rotational movement to the watch interaction member.

Further generally, the actuator device may include more than one actuator, if more than one degree of freedom is to be provided for interaction with the watch interaction member. More than one actuator may be also provided if more than one watch interaction member is used. For example, for each watch interaction member one or more separate actuators may be used in order to, e.g., provide one or more degrees of freedom for the respective watch interaction member and to enable actuation of the respective watch interaction member independently from the other watch interaction member(s). Further, more than one actuator may be included to increase reliability (e.g. using an actuator as backup for another one), increase durability (e.g. using more than one actuator at the same time), increase performance (e.g. using more than one actuator to have more actuation power), and/or to enable compact designs (e.g. using smaller actuators than a lager one) and integration (e.g. using actuator designs that can be accommodated in small housings and the like).

For example, in the case of a watch interaction member that can be interacted with along more than one degree of freedom (e.g. two degrees of freedom), the actuator device may include, for each of the more than one degree of freedom, an actuator (e.g. two actuators) for providing a respective actuator device output. As in the examples above, the transmission device may transmit a translational movement from an actuator as translational movement to the watch interaction member or may transform a rotational movement from an actuator into a translational movement to the watch interaction member. Similarly, the transmission device may transmit a rotational movement from an actuator as rotational movement to the watch interaction member or may transform a translational movement from an actuator into a rotational movement to the watch interaction member.

In yet further examples, where a watch interaction member may be interacted with along more than one translational degree of freedom and along more than one rotational degree of freedom, the actuator device may comprise, for each of the degrees of freedom, a respective actuator.

In any example involving more than more than one degree of freedom of interaction with the watch interaction member, the actuator device may comprise an actuator providing actuator device output for two or more degrees of freedom. For example, such an actuator may comprise an actuator device output for at least one translational degree of freedom and/or at least one rotational degree of freedom.

The actuator device may also comprise more than one actuator in the case of more than one watch interaction member. Then, for example, for each watch interaction member (e.g. depending on the kind and/or number of degrees of freedom of a watch interaction member), one or more actuator may be provided, for example as set forth above with respect to cases with one watch interaction member.

In examples involving more than one actuator, the transmission device may be used to receive the different actuator device outputs and transmit their respective movements either independently or in a kinematically interdependent way to the watch interaction member, or, in the case of more than one watch interaction member, to a respective one of the two or more watch interaction members. For such examples, as set forth further below with reference to FIG. 8A, the transmission device may comprise a parallel kinematics arrangement.

According to the example of FIG. 4A, the coupling of the actuator device 30 and the watch interaction member 26 comprises a transmission device 34 including a kinematics arrangement 34*a* and a connecting device 34*b*. The kinematics arrangement 34*a* comprises a lever linkage arrangement being coupled to the actuator device 30 and the connecting device 34*b*. The connecting device 34*b* may comprise, for example as shown, a bar or rod connecting the kinematics arrangement 34*a* and the watch interaction member 26.

According to FIG. 4A, the actuator device output of the actuator device 30 is transmitted via the kinematics arrangement 34*a* to the end of kinematics arrangement 34*a* coupled with the connecting device 34*b* and, thus, to the watch interaction member 26.

The transmission device may be formed such that it provides a "gear ratio" so that, for example, an actuator device output in form of a movement is converted into a respective larger or smaller movement, such gear ratio not necessarily being constant; this correspondingly applies to any other form of actuator device output.

In a further example, the transmission device may be formed such that it transmits the motion of the actuator device to a watch interaction member 2 in a direction which is different from the direction of motion of the actuator device, e.g. transmitting a vertical motion of the actuator device 30 as horizontal motion to the watch interaction member.

In a further example, the transmission device may be formed such that it transmits the motion of the actuator device 30 to a watch interaction member in a degree of freedom that is different from the degree of freedom of the actuator device, e.g. transmitting a rotational degree of freedom of the actuator device as a translational degree of freedom to the watch interaction member.

The WIS apparatus comprises a sensor device 36 adapted to sense an interaction of the watch interaction member and output sensor information indicating the sensed interaction.

The sensor device 36 is operatively coupled to the transmission device 34 such that interaction with the watch interaction member 26 that is transmitted via the transmission device 34 is sensed and a respective output sensor information is generated and outputted.

An exemplary sensor device 36 may comprise at least one of the following:

- a position sensor
- a relative displacement sensor
- a translational movement sensor
- a rotational movement sensor
- a translational velocity sensor
- a rotational velocity sensor
- a translational acceleration sensor
- a rotational acceleration sensor
- a force sensor
- a torque sensor An exemplary sensor device 36 may comprise at least one of the following:

- capacitive sensor
- inductive sensor
- piezoelectric sensor
- strain gage sensor optical sensor
fiber-based sensor
laser sensor
magnetic sensor The WIS apparatus comprises a sensor information computing device 38 being operatively coupled to the sensor device 36. The sensor information computing device 38 is adapted to receive, from the sensor device 36, the sensor information output indicating the sensed interaction and compute the received sensor information.

The sensor information computing device 38 may comprise its own user interface including a display 38*a* device and an input device 38*b*.

The WIS apparatus may comprise a transducer device 40 coupled to the watch interaction member. The transducer device 40 is adapted to generate, as transducer device output, at least one of mechanical, vibrational, haptic, tactile, acoustic and thermal energy. The coupling of the transducer device 40 and the watch interaction member 26 is adapted to transmit the transducer device output to the watch interaction member. In further examples, the transducer device 40 is coupled to the watch interaction member support 28. In further examples, the transducer device 40 is coupled with both the watch interaction member 26 and the watch interaction member support 28.

An exemplary transducer device 40 may comprise at least one of the following:

a vibrational transducer
an acoustic transducer
a thermal transducer

An exemplary transducer device 40 may providing at least one of the following transducer device outputs:

mechanical energy
vibrational energy
haptic energy
tactile energy
acoustic energy
thermal energy For example, an electrostatic or piezo-electric transducer can generate haptic information, and a braille-like moveable needle array display can display textures on the skin surface.

For control of the transducer device 40, a transducer control device 42 is provided. The transducer control device 42 may comprise its own user interface including a display 42*a* device and an input device 42*b*.

According to the illustrated examples, the coupling of the transducer device 40 and the watch interaction member 26 and, if applicable, the watch interaction member support 28 is provided by the transmission device 34, since the transmission device 34 may provide more than one coupling to the watch interaction member 26. However, in further examples, the coupling of the transducer device 40 may be provided by a further transmission device being separate from the transmission device 34.

For example, in the case the transducer device 40 is adapted to provide vibrational energy and vibration, respectively, the transducer device 40 and the watch interaction member 26 may be coupled via the transmission device 34 (e.g. as shown in FIG. 4A, via the kinematics arrangement 34*a* and the connecting device 34*b*) in manner that vibrations may be transmitted to the watch interaction member 26, where a user interacting with the watch interaction member 26 may perceive vibration.

The same correspondingly applies to any other form of transducer device output that may be provided to a watch interaction member.

For example, in the case the transducer device 40 is adapted to provide vibrational energy and vibration, respectively, the transducer device 40 and the watch interaction member support 28 may be coupled via the transmission device 34 in manner that vibrations may be transmitted to the watch interaction member support 28, where a user interacting with the watch interaction member support 28 may perceive vibration. According to FIG. 4A, the coupling of the transmission device 34 and the watch interaction member support 28 may include a further connection device 34*c* that couples the kinematics arrangement 34 and, thus, the transducer device 40 and the watch interaction member support 28.

The same correspondingly applies to any other form of transducer device output that may be provided to a watch interaction member.

A vibrotactile transducer device can be used in serial kinematics arrangement with an actuator device in order to enhance the perceived bandwidth at the interaction member.

The transducer device 40 may include more than one transducer, the output of which may be transmitted separately to the watch interaction member support and/or the watch interaction member (by means of a transmission device include a respective transmission component(s) for each transducer) and/or may be combined by means of the transmission device (e.g. by means of a transmission device including component(s) transmitting vibration and temperature to a watch interaction member).

As illustrated in FIG. 3A, at least one of actuator control device 32, the sensor information computing device 38 and the transducer control device 42 may be provided as separate component. According to FIG. 4A, the actuator control device, the sensor information computing device and the transducer control device may be comprised by a system control device 44.

The following descriptions with respect to the system control device 44 as well as its functionalities and components respectively apply to the actuator control device 32, the sensor information computing device 38 and the transducer control device 42 as well as its functionalities and components. For example, examples described with reference to a user interface and power supply also apply to the user interface and power supply of, e.g., the actuator control device 32. Examples described with reference to functionalities and components of the system control device with respect to the actuator device 30 correspondingly apply to the actuator control device 32.

The system control device 44 may provide functionalities (e.g. software and/or hardware based) enabling to control the actuator device 30 and/or the transducer device 40 such that the output necessary for and perceived by user for an interaction with the watch interaction member are at targeted levels. To this end, the system control device 44 may use sensor information output, for example, to determine whether the control of the actuator device 30 and/or the transducer device 40 is such that the targeted levels are actually achieved at the watch interaction member 26. In other words, in such examples, the system control device 44 may use a closed loop control of the actuator device 30 and/or the transducer device 40 by means of the sensor device 36.

The system control device 44 may comprise a user interface including a display device 44*a* and an input device 44*b*. The display device 44*a* and/or the input device 44*b* may be connected to the remaining parts of the system control device 44 by wired connections and/or wireless connections. In the latter case of wireless connections, data provided by their system control device 44 can be displayed at a remote location and/or control input via the input device 44*b* can be inputted from the same remote location or a different remote location. Such examples may be used, for example, if, as set forth further down below, the WIS apparatus is arranged (at least partly) in the watch interaction member support 28.

The display device 44*a* may be used to display controlled levels of the actuator device 30 and/or the transducer device 40 to visually see/control the setting and behavior of the WIS apparatus and/or to display sensor information output to visualize interaction of a user with the watch interaction member 26. The input device 44*b* may comprise physical input devices such as keyboard, buttons, mouse etc. and/or virtual input devices such as icons, buttons, sliders etc. displayed at the display device 44*a*. In the latter cases of virtual input devices, the input device 44*b* may be, at least partly, part of the display device 44*a*, particularly in the case the display device 44*a* comprises touch-input functionalities. In further examples, the input device 44*a* may be adapted to receive user input in form speech/voice and/or gesture as well as input provided from a sensor glove and/or specific sensors sensing brain activity and/or eye movement and/or other information that can be obtained from the body of a user.

The system control device 44 may include software and/or hardware being adapted to, for example, set, modify, etc. one or more values of modeled physical parameters (e.g. friction, force threshold or stroke length) for the behavior of the watch interaction member 26. To this end, the system control device 44 may use, for example, finite element models FEM, rigid body mechanism models or physics equation solvers.

In further examples, the system control device 44 may include software and/or hardware being adapted to, for example, set, modify, etc. data from curves based on measurements gathered from manipulation of a watch interaction member on a real watch, e.g. curve of measured forces in response to a constant velocity displacement of a winding crown 18.

The system control device 44 may be coupled with an external, portable energy supply 46 (e.g. rechargeable portable battery) to allow operation of the WIS apparatus and the WIS system, respectively at any location. In other examples, the energy supply 46 may be provided, e.g., via a stationery power socket.

The system control device 44 may be adapted to store or save parameters and/or settings for at least one of the actuator, sensor device, breaking device, locking device and watch interaction member.

The system control device 44 may be adapted to record user interaction with the watch interaction member (e.g. force, torque etc.) and/or to load, recall or replay recorded user interaction with the watch interaction member at a later point in time, wherein the recorded user interaction data may be collected by the system control device 44 or may be provided by another system.

Like FIGS. 3A and 4*a*, FIG. 3B, in more general terms, and FIG. 4B, in greater detail, illustrate a WIS (watch interaction simulation) system or, in other words, a WIS apparatus and an arrangement for simulation of a watch comprising a watch interaction member 26 and a watch interaction member support 28, where—in addition to the components of FIG. 3A—a breaking device and/or a locking device are included. The above observations with respect to FIGS. 3A, 4B and 8A apply here correspondingly and, thus, are not repeated.

In addition to the examples of FIGS. 3A and 4A, the examples of FIGS. 3B and 4B may include a breaking device 43.

The coupling of the breaking device 43 and the watch interaction member 26 is adapted to transmit the breaking device output (particularly breaking force and/or torques) to the watch interaction member. The breaking device 43 serves to act against interaction (e.g. forces and/or torques) of a user with the watch interaction member 26, particularly such that a user has to work against the action of the breaking device.

Generally, the function of the breaking device 43 could be also provided by the actuator device 30. However, using the breaking device 43 allows to apply breaking action by the breaking device 43 and actuation action by the actuator device 30 independently and/or simultaneously.

An exemplary breaking device 43 may comprise at least one of the following:

- a frictional break
- an electromagnetic break
- a magneto rheological fluid brake
- an actuator providing actuator output being not depending from the actuator output of the actuator device 30

For control of the breaking device 43, a breaking control device 47 is provided. The breaking control device 47 may comprise its own user interface including a display 47*a* device and an input device 47*b*.

The breaking device 43 may by controlled, e.g., over the level or the duration of the applied breaking force and/or its behavior. The breaking device could e.g. have symmetrical behavior with respect to the direction of motion or have a specific behavior depending on the direction of motion or only engaged when motion occurs in a specific direction. This breaking device could for example generate a dry friction or viscous force.

According to the illustrated examples, the coupling of the breaking device 43 and the watch interaction member 26 and, if applicable, the watch interaction member support 28 is provided by the transmission device 34, since the transmission device 34 may provide more than one coupling to the watch interaction member 26. However, in further examples, the coupling of the breaking device 43 may be provided by a further transmission device being separate from the transmission device 34.

Further, in addition to the examples of FIGS. 3A and 4A, the examples of FIGS. 3B and 4B may include a locking device 49.

The coupling of the locking device 49 and the watch interaction member 26 is adapted to transmit the locking device output (particularly locking force and/or torques) to the watch interaction member. The locking device 49 serves to lock the watch interaction member 26 with respect to interaction (e.g. forces and/or torques) of a user with the watch interaction member 26, particularly such that a user interaction does not result in movement of the watch interaction member 26

Generally, the function of the locking device 49 could be also provided by the actuator device 30 and/or the breaking device 43. However, using the locking device 49 allows to apply locking action by the locking device 49 and/or breaking action by the breaking device 43 and/or actuation action by the actuator device 30 independently and/or simultaneously.

An exemplary locking device 49 may comprise at least one of the following:

- a structural engagement device (e.g. pin and slot/hole)
- an electromagnetic lock
- an actuator providing actuator output being not depending from the actuator output of the actuator device 30 and the breaking output of the breaking device 43

The breaking device 43 may be fully passive (e.g. a mechanical end-stop) or have one or more active components and possibly include means for engaging (or clutching) and/or controlling it (e.g. manually, automatically or actively).

For control of the locking device 49, a locking control device 51 is provided. The breaking control device 51 may comprise its own user interface including a display 51*a* device and an input device 51*b*.

The locking device 49 may by controlled, e.g., over the position in space where the lock is engaged (e.g. by means of an auxiliary electrical motor), the stiffness associated with the locked state or the direction of motion where the lock engages. The locking device 49 could e.g. have symmetrical behavior with respect to the direction of motion or have a specific behavior depending on the direction of motion or only engaged when motion occurs in a specific direction. The locking device 49 could e.g. have one or a multiplicity of locked position, or be engageable at any position. Usage of a locking device 49 can help to overcome limitations in actuator devices, e.g. rendering of a high force or stiffness with reduced apparent inertia at a given static position.

According to the illustrated examples, the coupling of the locking device 49 and the watch interaction member 26 and, if applicable, the watch interaction member support 28 is provided by the transmission device 34, since the transmission device 34 may provide more than one coupling to the watch interaction member 26. However, in further examples, the coupling of the locking device 49 may be provided by a further transmission device being separate from the transmission device 34.

FIG. 4C illustrates another WIS (watch interaction simulation) system or, in other words, a WIS apparatus for a bracelet (of watchstrap), e.g. bracelet 6 of FIG. 1. Bracelet 6 has a clasp (or catch) C, by means of which the bracelet 6 can be opened/closed or enlarged/reduced so that a user can attach the watch at the user's arm. Clasp C can be operated by a push button 6*a* and/or a push button 6*b*. Pushing at least one of the push buttons 6*a* and 6*b* releases the clasp C for opening/enlarging bracelet 6. For closing/reducing bracelet 6, usually none of the push buttons 6*a* and 6*b* need to be operated by a user.

FIG. 4C also shows a WIS (watch interaction simulation) apparatus, examples of which being described, e.g., with respect to FIGS. 3A, 3B, 4A and 4B above and, further down below, with respect to FIGS. 8A-8C.

The WIS of FIG. 4C has a connecting device 34*b* providing a coupling of the at least one of the push buttons 6*a* and 6*b*. The observations given above with respect to the connecting device 34*b* of FIGS. 3A-B and 4A-B apply here also and, thus, are not repeated.

By means of the WIS, the perception of real push buttons can be provided, as in the cases explained above.

FIGS. 5A and 5B illustrate an example of the WIS system and WIS apparatus, respectively, where the WIS apparatus is mostly accommodated in a WIS apparatus housing 48. As illustrated, just parts of the transmission device 34 extend beyond the WIS apparatus housing 48 allowing to be coupled with the watch interaction member 26.

According to FIGS. 5A and 5B, there is a transducer device 40 comprising an acoustic transducer 40*a* being coupled to the watch interaction member support 28 so that energy outputted by the acoustic transducer 40*a* (e.g. vibration) can be transmitted to the watch interaction member support 28 and therefrom to the watch interaction member 26.

In the example of FIG. 5, the WIS apparatus housing 48 comprises an arrangement portion 50, which may be used to arrange the watch interaction member support 28 at the WIS apparatus, particularly such that the watch interaction member 26 may be coupled to the WIS apparatus and its transmission device 34, respectively. As shown in FIG. 5A, the arrangement portion 50 may include holes, bore, recesses, openings and the like (in the following also referred to as mechanical interfaces 52), by means of which the watch interaction member support 28 may releasably connected to the arrangement portion 50. Generally, it is envisaged that such mechanical interfaces are designed for quick and easy interchangeability of different watch interaction member supports.

The arrangement portion 50 may be adapted to arrange the watch interaction member support 28 in one or more positions; further observations in this respect can be found in relation to FIG. 7 further below.

The watch interaction member 26 may have just the form of a winding crown as illustrated in FIG. 4A and coupled with connecting device 34*b*. In further examples, the watch interaction member 26 may comprise, in addition to its part having the form of a watch interaction member intended for use in real watch, a connecting element 26*a*. The connecting element 26*a* serves as interface for coupling the watch interaction member 26 and the transmission device 34. In the example of FIG. 5A, the connecting element 26*a* comprises a rod that extends from the part of the watch interaction member 26 having the form of a winding crown and having, at its free end, a portion that can be connected to the transmission device 34. According to FIG. 5A, the connecting device 34*b* has a connection portion 34*d* that, e.g., allows screwing, clamping etc. together the connecting device 34*b* and the connecting element 26*a*. In other examples, the transmission device 34 and, if applicable, the connecting device 34*b* may be connected directly to the watch interaction member 26.

Generally, also parts for connecting the transmission device 34 and the watch interaction member 26 (also referred to as connection portion 34*d* and connecting element 26*a*) are designed for quick and easy interchangeability, here, with respect to different watch interaction members.

In the example of FIG. 5, the WIS apparatus housing 48 is connected to a housing base 54.

The arrangement of the WIS apparatus in relation to the watch interaction member support 28 and the watch interaction member 26 may depend, inter alia, from the location where the watch interaction member 26 is disposed at the watch interaction member support 28. As shown in FIG. 1, watch interaction members may be disposed at different locations at a watch housing. The same applies to the watch interaction member 26 and the watch interaction member support 28. For example, the watch interaction member 26 may be located at 12 o'clock, 6 o'clock, 9 o'clock or any location therebetween.

As illustrated in FIGS. 5A and 5B, the watch interaction member support 28 is positioned in relation to the WIS apparatus such that the connection portion 34*d* can be coupled with the watch interaction member 26 being positioned at 3 o'clock of the watch interaction member support 28. This position of the watch interaction member support 28 is referred to as position A.

As illustrated in FIG. 6, the arrangement of watch interaction member support 28 in relation to the WIS apparatus may be modified. To this end, the arrangement portion 50 may have mechanical interfaces enabling the watch interaction member support 28 to be connected in different positions and/or a mechanical interface that allows displacement (e.g. rotation, translation) of the watch interaction member support 28 in relation to the WIS apparatus. As example, FIG. 6 illustrates a position of the watch interaction member support 28 in relation to the WIS apparatus and its arrangement portion 50 (referred to as position B), which position B being displaced with respect to the above position A of FIGS. 5A and 5B.

Assuming the transmission device 34 of FIG. 4A, position A allows a coupling with a watch interaction member at the 3 o'clock position (designated as I in FIG. 6), while position B allows a coupling with a watch interaction member at a position between the 3 o'clock position and the 12 o'clock position (designated as II in FIG. 6). This allows using the identical WIS apparatus and the identical watch interaction member support 28 to simulate and/or evaluate different watch interaction members at different locations at the watch interaction member support 28. For example, the position A may be used for simulation and/or evaluation of interaction with a winding crown, while position B may be used for simulation and/or evaluation of interaction with a start/stop pusher.

Another exemplary arrangement of, on the one hand, the WIS apparatus and, on the other hand, the watch interaction member support 28 is illustrated in FIG. 7. The arrangement of the WIS apparatus in relation to the watch interaction member support 28 and the watch interaction member 26 may also depend from the location where the watch interaction member support 28 is disposed in relation to the WIS apparatus. For example, as illustrated in FIGS. 5 and 6, the WIS apparatus may be located at 9 o'clock of the watch interaction member support 28. In further examples, the WIS apparatus may be located at 12 o'clock of the watch interaction member support 28 (shown in FIG. 7), at 6 o'clock, 3 o'clock or any location therebetween.

FIG. 8A illustrates an example of a WIS apparatus comprising a transmission device 34 including a parallel kinematics arrangement PKA and an actuator device 30 comprising an actuator 30*a* and an actuator 30*b*. The following observations with respect to FIG. 8A correspondingly apply to examples an actuator device 30 comprising three or more actuators.

The actuator 30*a* provides, as actuator output, translational movements as indicated by arrow TM (according to FIG. 8A from left to right and vice versa). Therefore, the actuator 30*a* is referred to as translational actuator.

The actuator 30*b* provides, as actuator output, rotational movements as indicated by arrow RM (according to FIG. 8A from rotations about the horizontal axis). Therefore, the actuator 30*b* is referred to as rotational actuator.

The parallel kinematics arrangement PKA comprises an input member PKA-IN1 coupled with, on the one hand, the translational actuator 30*a* and, on the other hand, a kinematics bond PKA-KB1.

The parallel kinematics arrangement PKA further comprises an input member PKA-IN2 coupled with, on the one hand, the rotational actuator 30*b* and, on the other hand, a kinematics bond PKA-KB2.

The kinematics bond PKA-KB1 and the kinematics bond PKA-KB2 are coupled by an intermediate member PKA-IM.

The parallel kinematics arrangement PKA comprises an output member PKA-OUT coupled with the watch interaction member 26 (e.g. as explained above by means of connecting portion 34*d* and the connecting element 26*a*).

The kinematics bond PKA-KB1 comprises a rotational joint PKA-J1 and the kinematics bond PKA-KB2 comprises a translational joint PKA-J2.

Translational actuator output of the translational actuator 30*a* is transmitted via the input member PKA-IN1 to the parallel kinematics arrangement PKA and rotational actuator output of the rotational actuator 30*b* is transmitted via the input member PKA-IN2 to the parallel kinematics arrangement PKA.

A translation actuator output received from the translational actuator 30*a* via the input member PKA-IN1 results in a respective translational movement of the kinematics bond PKA-KB1, which can be moved translationally due to the translational joint PKA-J2 in kinematics bond PKA-KB2. The translational movement of the kinematics bond PKA-KB1 is transmitted via the output member PKA-OUT to the watch interaction member 26. As a result, the movement of the output member PKA-OUT is a translation. Due the coupling of the output member PKA-OUT and the watch interaction member 26, the watch interaction member 26 can exhibit a translational behavior and, thus, is provided one degree of freedom.

A rotational actuator output received from the rotational actuator 30*b* via the input member PKA-IN2 results in a respective rotational movement of the kinematics bond PKA-KB2, which can be moved rotationally due to the rotational joint PKA-J1 in kinematics bond PKA-KB1. The rotational movement of the kinematics bond PKA-KB2 is transmitted via the kinematics bond PKA-KB2 and the output member PKA-OUT to the watch interaction member 26. As a result, the movement of the output member PKA-OUT is a rotation. Due the coupling of the output member PKA-OUT and the watch interaction member 26, the watch interaction member 26 can exhibit a rotational behavior and, thus, is provided one degree of freedom.

If both the translational actuator 30*a* and the rotational actuator 30*b* provide output to the parallel kinematics arrangement PKA, both the kinematics bond PKA-KB1 and the kinematics bond PKA-KB2 are moved (translation and rotation). As a result, the movement of the output member PKA-OUT is a combination of translation and rotation. Due the coupling of the output member PKA-OUT and the watch interaction member 26, the watch interaction member 26 can exhibit a behavior combining translational and rotational components and, thus, is provided two degrees of freedom.

In further examples, a parallel kinematics may be used in combination with more than one translational actuator at least some of which providing translational actuator output in different directions, and/or more than one rotational actuator, at least some of which providing rotatory actuator output in different directions. In such examples, the actuators are coupled with respective input member to input their actuator output into the parallel kinematics arrangement, wherein the input members are coupled with respective kinematics bonds, which in turn are coupled with each other. At least one of the kinematics bond may be coupled with an output member. In such examples, the watch interaction member 26 can exhibit a behavior combining translational and/or rotational components in several directions and, thus, is provided with several degrees of freedom.

The WIS may comprise at least two actuator devices 30. Further, the coupling of such at least two actuator devices 30 and the watch interaction member 26 may comprise a combined transmission device 34 including a parallel kinematics arrangement 34*a* PKA which transmits the outputs of said at least two actuator devices 30 in a combined way to a same watch interaction member 26, thereby providing at least two degrees of freedom to such watch interaction member 26.

Interaction with a watch as such and, particularly, with a watch interaction member also includes visual interaction. Interaction of a user with a watch interaction member often results in something that the user can perceive, particularly can see. For example, using a winding crown for adjusting the time setting results in movements of the watch hands, or using a pusher for starting/stopping a stop-watch functionality of a watch result effects that a sweep second hand starts/stops moving. In other words, interaction with a watch interaction member of a watch may result in visual watch information provided by the watch.

Such visual watch information from a watch will be often used by the user as feedback information for the interaction with the watch interaction member. For example, a user may adapt the time-adjustment interaction with a winding crown depending on the way (e.g. speed or mechanical backlash) the watch hands are moved; or a user may adapt the start-stop-interaction with a start/stop pusher (e.g. pushed/presses stronger or weaker, faster or slower) depending from the way a sweep second hand starts/stops moving. In such cases, it can be said that the visual watch information from the watch is objective feedback information supporting the user in the interaction with the watch interaction member.

However, visual watch information from a watch in response to interaction with a watch interaction member may have also subjective aspects. For example, a user may perceive the way watch hands are moved in response to a time-adjustment interaction with a winding crown or the way a sweep second hand starts/stops in response to a start/stop-interaction as elegant and refined, while different ways the watch hands or the sweep second hand starts/stops may be perceived as clumsy and crude.

In order to take into account at least one of objective feedback and subjective aspects of visual watch information from a watch in response to interaction with a watch interaction member, an imaging device may be used.

In some examples, the watch interaction member support 28 may be provided, at the location where a clock face is arranged in a real watch, with a display surface on which visual watch information from a watch in response to interaction with a watch interaction member may be displayed. Such a display surface may be, for example, a flat panel display (e.g. LED or OLED).

FIG. 8B illustrates an example of a WIS apparatus comprising a transmission device 34 (optionally including a parallel kinematics arrangement PKA) and an actuator device 30. For example, an arrangement of the transmission device 34 including a parallel kinematics arrangement PKA and an actuator device 30 may be that shown in FIG. 8A. Further, an arrangement of the transmission device 34 and an actuator device 30 may be according to FIGS. 3A and 4A. Generally, any arrangement WIS apparatus according to the present disclosure may be employed.

Like in the examples of FIGS. 3B and 4B, the example of FIG. 8B includes a breaking device 43 and/or locking device 49.

First, a possible operation of the breaking device 43 is described. The breaking device 43 includes a breaking actuator 43*a*, a sensor 43*a*, a kinematics link 43*c* and an engagement device 43*d*.

The engagement device 43*d* may have a fork/slot like form or any other form being adapted to engage with engagement element 26*c* of watch interaction member 26. The engagement element 26*c* may be a pin, protrusion and the like.

The breaking actuator 43*a* is coupled with the kinematics link 43*c* and, thus, the engagement device 43*d*. The breaking actuator 43*a* is adapted to rotate the kinematics link 43*c* and, thus, the engagement device 43*d*, as indicated by the arrow RBL. Particularly, the breaking device 43 is adapted to rotate the engagement device 43*d* in synchronization with rotations of the engagement element 26*c* of watch interaction member 26. To control operation of the breaking actuator 43*a* accordingly, sensor 43*a* is used.

To provide a breaking action, for example in the case of a clockwise rotation of the watch interaction member 26, the engagement device 43*d* is also rotated clockwise, particularly in such a manner that an abutment element 43*d*1 is, in the clockwise rotational direction, ahead of the engagement element 26*c* of the watch interaction member 26. In the case, the abutment element 43*d*1 and the engagement element 26*c* are in contact during such a movement, breaking forces/torques can applied on the watch interaction member.

To provide a breaking action, for example in the case of an anti-clockwise rotation of the watch interaction member 26, the engagement device 43*d* is also rotated clockwise, particularly in such a manner that an abutment element 43*d*2 is, in the anti-clockwise rotational direction, ahead of the engagement element 26*c* of the watch interaction member 26. In the case, the abutment element 43*d*2 and the engagement element 26*c* are in contact during such a movement, breaking forces/torques can applied on the watch interaction member.

If breaking action should be provided just in one rotational direction, it is possible to use just a respective one of the abutment elements 43*d*1 and 43*d*2.

In order to provide direct/immediate breaking action in all rotational direction of the watch interaction member 26, the space between the abutment elements 43*d*1 and 43*d*2 can made as small as possible, as long the engagement element 26 of the watch interaction member 26 can engage the engagement device 43*d*.

The example of FIG. 8B can be, alternatively or in addition, adapted and/or operated to provide a locking action. Such locking action can practically be achieved by coupling the breaking actuator 43*a* (e.g. an electromagnetic motor) with a transmission means 43*e* having high gear ratio (e.g. planetary gear stages or harmonic drive) so that the output shaft of this transmission means cannot be rotated from its output end (i.e. is locked or mechanically non-back-driveable due to its internal friction), but can only be rotated from its input end engaging with the breaking actuator output shaft (e.g. planetary gear head or harmonic drive).

The example of FIG. 8C includes the components of FIG. 8B unless otherwise noted.

In contrast to FIG. 8C, the example of FIG. 8C includes a breaking device 43 and a locking device 49 as separate devices.

The locking actuator 49*a* allows translational movements of the kinematics link 49*c* and the engagement device 49*d*, as indicated by the arrow TL.

If the locking actuator 49*a* is actuated such that the engagement device 49*d* is positioned such that the engagement element 26*c* of the watch interaction member 26 can or is contacted by one of the abutment elements 49*d*1 and 49*d*2 (i.e. engagement device 49*d* is moved/positioned to the right), breaking and/or locking action can be provided by means of the breaking device 43 to the watch interaction member 26, as explained with reference to FIG. 8B.

If the locking actuator 49*a* is actuated such that the engagement device 49*d* is positioned such that the engagement element 26*c* of the watch interaction member 26 cannot by contacted by one of the abutment elements 49*d*1 and 49*d*2 (i.e. engagement device 49*d* is moved/positioned to the left), no locking and/or breaking action can be provided to the watch interaction member 26.

In further examples, an arrangement without the breaking device 43 can be used (e.g., link 43*c* connected to ground or a base). In such case, locking action can be provided, if the locking actuator 49*a* is actuated such that the engagement device 49*d* is positioned such that the engagement element 26*c* of the watch interaction member 26 can or is contacted by one of the abutment elements 49*d*1 and 49*d*2 (i.e. engagement device 49*d* is moved/positioned to the right). If the locking actuator 49*a* is actuated such that the engagement device 49*d* is positioned such that the engagement element 26*c* of the watch interaction member 26 cannot by contacted by one of the abutment elements 49*d*1 and 49*d*2 (i.e. engagement device 49*d* is moved/positioned to the left), no locking action can be provided.

FIG. 9 illustrates an example where the display surface is made of diffusive and/or reflexive material (e.g. white) and forms a projection surface 58 illuminated by a projection camera 56 which may project such visual watch information onto it. For example, assume a watch interaction member 26 in the form of a winding crown and an interaction with the watch interaction member 26 in form of a time-adjustment interaction. Then, the projection camera 56 may project, onto the projection surface, images resembling visual impressions of watch hands and, in response to and depending from the time-adjustment interaction, images resembling visual impressions of watch hands being moved in response to the time-adjustment interaction. As further example, assume a watch interaction member 26 in the form of a start/stop pusher and an interaction with the watch interaction member 26 in form of a start/stop-interaction. Then, the projection camera 56 may project, onto the projection surface, images resembling visual impressions of a sweep second hand and, in response to and depending from the start/stop-interaction, images resembling visual impressions of the sweep second hand being started/stopped in response to the start/stop interaction and, also, images resembling visual impression of the sweep second hand moving after being started.

In further examples, the projection surface 58 may be larger than the location where a clock face is arranged in a real watch, e.g. large enough so that it covers at least in part the location where the watch housing and/or bracelet (watchstrap) is arranged in a real watch. In such examples, the projector can render visual information of the watch housing and/or bracelet (watchstrap) material (e.g. to resemble brushed steel). The projection surface may also include WIS apparatus housing 48 parts, which can be used to display additional information from the user interface (e.g. the current function corresponding to the translational position of the watch interaction member 26).

In further examples, a VR (virtual reality) environment may be used for simulation and/or evaluation of interaction with a watch interaction member. For example, a head-mounted display or a mirror-based collocated display may be used to provide a user with the visual impression of wearing a watch. Then, in response to interaction of the user with a watch interaction member 26 used for simulation and/or evaluation by means of the WIS apparatus, the VR environment (e.g. by means of a head-mounted display or a mirror-based collocated display) may provide the user with the visual impression of the effects the interaction has on the watch. If tracking means are provided for the user's head motion, the viewpoint in the VR may be adjusted accordingly. If additional tracking means are provided for the user's body and/or limbs, a virtual representation of the user's body can be represented accordingly in the VR, e.g. to display in VR the user's arm wearing a virtual watch possibly collocated spatially to the where the real arm would be perceived by the user in reality.

According to above drawings, the WIS apparatus is arranged, apart from parts of the transmission device 34 being arranged at least partially inside the watch interaction member support 28 for coupling to the watch interaction member 26, outside the watch interaction member support 28. In further examples, at least parts of the WIS apparatus and in yet further examples the WIS apparatus as a whole may accommodated inside the watch interaction member support 28. In the latter examples where at least parts of the WIS apparatus may be held within the watch interaction member support 28, the WIS system (i.e. WIS apparatus and watch interaction member support 28 and watch interaction member 26) can be worn by a user like a real watch at the user's wrist. In such examples, but also in any other example, the system or control device 44 may include a wireless transmitter for transmitting data to a remote system (e.g. system computing device 45) and, in further examples, also a wireless receiver for receiving data from the remote system or another remote system (e.g. system computing device 45).

With reference to FIG. 10, the following describes possible simulation and/or evaluation using the WIS system. For the sake of illustration only, without limitation in any respect, it is assumed that a watch interaction member support 28 is used together with a watch interaction member 60 in form of a winding crown and a watch interaction member 62 in form of a start pusher 22 as well as a watch interaction member 64 in form of a stop pusher 24.

In the example of FIG. 10, the watch interaction member support 28 comprises a bracelet (watchstrap) 66. By means of the WIS apparatus, technical functions and/or properties and/or behavior of a real movement of a real watch, particularly with respect to the coupling to watch interaction members, can be simulated and mimicked.

The watch interaction member support 28 is provided with visual watch information in form of a big watch hand (also referred to as hour watch hand) 70 and a small watch hand (also referred to as minute watch hand) 72 as well as a calendar work (also referred to as date display) 74 and a sweep second hand 76 (i.e. a hand providing a stop-watch function of the watch 2) (also referred to as virtual hour watch hand, virtual minute watch, virtual calendar work, virtual sweep second hand).

In further examples, rather than using visual watch information (only), at least one of the hour watch hand 70, the minute watch hand 72, the calendar work 74 and the sweep second hand 76 may be provided as real physical part of the watch interaction member support 28. In such cases, the WIS apparatus may also simulate or mimic technical functions and/or properties and/or behavior of a real movement of a real watch as regards interaction of the movement and respective real watch parts (e.g. hour/minute watch hands, calendar work, sweep second hand). This may be accomplished by means of the transmission device 34 or, in further examples a real watch movement arranged, e.g., in the watch interaction member support 28.

The above observations with reference to FIG. 1, particularly those relating to the hour watch hand 10, the minute watch hand 12, the calendar work 14 and the sweep second hand 16 correspondingly apply to the hour watch hand 70, the minute watch hand 72, the calendar work 74 and the sweep second hand 76, even if they are only visual watch information and not physically existing watch parts.

As regards the watch interaction member 60 in form of a winding crown (in the following short winding crown 60), the following relates to simulation and evaluation of the interactions described with reference to the winding crown 18 of FIG. 1.

The system control device 44 (or in other examples, the actuator control device 32) controls the actuator device 30 in such a manner that a SIP position, a SOP position, a WUP position, a TAP position and a DAP position and the respectively associated functions and/or movements are provided for the winding crown 60. To this end, the actuator device 30 is controlled to effect operations of itself and/or operations of the transmission device 34 applying forces, torques, movements and the like which a user interacting with winding crown 60 should apply and/or perceive for at least one of the following interactions (please note that the above observations with respect to force and/or torque necessary for and perceived by a user for the interactions with a watch interaction member described with reference to FIG. 1 apply here correspondingly):

Bringing the winding crown 60 in the SOP position
Bringing the winding crown 60 in the SIP position
Bringing the winding crown 60 in the WUP position
Carrying out a winding-up interaction
Bringing the winding crown 60 in the TAP position
Carrying out a time-adjustment interaction
Bringing the winding crown 60 in the DAP position
Carrying out a day/date-adjustment interaction
Bringing the winding crown 60 back in the TAP position
Bringing the winding crown 60 back in the WUP position
Bringing the winding crown 60 back in the SOP position
Bringing the winding crown 60 back in the SIP position As regards the watch interaction member 62 in form of a start pusher (in the following short start pusher 62), the following relates to simulation and evaluation of the interactions described with reference to the start pusher 22 of FIG. 1.

The system control device 44 (or in other examples, the actuator control device 32) controls the actuator device 30 in such a manner that a not activated/pushed/pressed position, an activated/pushed/pressed position and movements therebetween and the respectively associated functions and/or movements are provided for the start pusher 62. To this end, the actuator device 30 is controlled to effect operations of itself and/or operations of the transmission device 34 applying forces, torques, movements and the like which a user interacting with the start pusher 62 should apply and/or perceive for at least one of the following interactions (please note that the above observations with respect to force and/or torque necessary for and perceived by a user for the interactions with a watch interaction member described with reference to FIG. 1 apply here correspondingly):

Pushing the start pusher 62 (start-interaction or restart-interaction)
Releasing the start pusher 62

As regards the watch interaction member 64 in form of a stop pusher (in the following short stop pusher 64), the following relates to simulation and evaluation of the interactions described with reference to the stop pusher 24 of FIG. 1.

The system control device 44 (or in other examples, the actuator control device 32) controls the actuator device 30 in such a manner that a not activated/pushed/pressed position, an activated/pushed/pressed position and movements therebetween and the respectively associated functions and/or movements are provided for the stop pusher 64. To this end, the actuator device 30 is controlled to effect operations of itself and/or operations of the transmission device 34 applying forces, torques, movements and the like which a user interacting with the stop pusher 64 should apply and/or perceive for at least one of the following interactions (please note that the above observations with respect to force and/or torque necessary for and perceived by a user for the interactions with a watch interaction member described with reference to FIG. 1 apply here correspondingly):

Pushing the stop pusher 64 (stop-interaction or reset-interaction)
Releasing the stop pusher 64

For each of the above interactions, the sensor device 36 may measure how the user interacts with at least one of the winding crown 60, the start pusher 62 and the stop pusher 64 and provide respective sensor information output, which can be used as closed-loop feedback information for control of the actuator device 30 and/or can be used to monitor, record, evaluate the actual interaction activities of the user with a respective one of the winding crown 60, the start pusher 62 and the stop pusher 64.

For each of the above interactions, at least one of the hour watch hand 70, the minute watch hand 72, the calendar work 74 and the sweep second hand 76—irrespective of whether being provided in virtual form as part of visual watch information or in physical form—may be displayed or operated such as the effect of an interaction with the watch interaction members can be visually perceived by the user.

The above simulation and/or evaluation of the behavior of each of the watch interaction member 60 in form of a winding crown 18 and the watch interaction member 62 in form of a start pusher 22 as well as the watch interaction member 64 in form of a stop pusher 24, may be repeated for one or more further watch interaction members in form of a winding crown having differently designed facets in order to simulate and/or evaluate the effect of different facets on the behavior of watch interaction members in form of a winding crown. In the same way, winding crowns having different shapes can be simulated and/or evaluated. Also, one or more further watch interaction members in form of a start pusher having differently designed shape can be used in order to simulate and/or evaluate the effect of different shapes on the behavior of watch interaction members in form of a start pusher, and/or for one or more further watch interaction members in form of a stop pusher having differently designed shape in order to simulate and/or evaluate the effect of different shapes on the behavior of watch interaction members in form of a stop pusher.

| Reference numeral list | |
|---|---|
| watch | 2 |
| watch housing | 4 |
| bracelet/watchstrap | 6 |
| Push button of bracelet/watchstrap | 6a |
| Push button of bracelet/watchstrap | 6b |
| movement | 8 |
| big/hour watch hand | 10 |
| small/minute watch hand | 12 |
| calendar work/date display | 14 |
| sweep second hand | 16 |
| bezel | 17 |
| winding crown | 18 |
| facet of the winding crown | 20 |
| screwed in position | SIP |
| screwed out position | SAP |
| screw rotation | SR |
| winding up position | WUP |
| time adjustment position | TAP |
| TAP resistance | TAP resistance |

-continued

| Reference numeral list | |
|---|---|
| day/date adjustment position | DAP |
| DAP resistance | DAP resistance |
| start pusher | 22 |
| stop pusher | 24 |
| Force step | FI |
| catch of bracelet 6 | C |
| watch interaction simulation system | WIS system |
| watch interaction simulation apparatus | WIS apparatus |
| watch interaction member | 26 |
| connecting element of watch interaction member | 26a |
| engagement element of watch interaction member | 26c |
| watch interaction member support | 28 |
| actuator device | 30 |
| translational actuator | 30a |
| rotational actuator | 30b |
| directions of translational movements of actuator 30a | TM |
| directions of rotational movements of actuator 30b | RM |
| actuator control device | 32 |
| display device of user interface of actuator control device | 32a |
| input device of user interface of actuator control device | 32b |
| transmission device | 34 |
| kinematics arrangement | 34a |
| connecting device | 34b |
| parallel kinematics arrangement | PKA |
| input member of parallel kinematics arrangement | PKA-IN1 |
| input member of parallel kinematics arrangement | PKA-IN2 |
| kinematics bond of parallel kinematics arrangement | PKA-KB1 |
| kinematics bond of parallel kinematics arrangement | PKA-KB2 |
| intermediate member of parallel kinematics arrangement | PKA-IM |
| output member of parallel kinematics arrangement | PKA-OUT |
| rotational joint of parallel kinematics arrangement | PKA-J1 |
| translational joint of parallel kinematics arrangement | PKA-J2 |
| directions of rotational movements of actuator 43a/49a | RBL |
| directions of translational movements of actuator 30b | TL |
| connecting device | 34c |
| connection portion | 34d |
| sensor device | 36 |
| sensor information computing device | 38 |
| display device of user interface of sensor information computing device | 38a |
| input device of user interface of sensor information computing device | 38b |
| transducer device | 40 |
| acoustic transducer | 40a |
| transducer control device | 42 |
| display device of the transducer control device | 42a |
| input device of the transducer control device | 42b |
| breaking device | 43 |
| sensor for breaking device | 43a |
| kinematics link | 43b |
| engagement device | 43c |
| abutment element | 43c1 |
| abutment element | 43c2 |
| system control device | 44 |
| display device of the system control device | 44a |
| input device of the system control device | 44b |
| system computing device | 45 |
| energy supply | 46 |
| breaking control device | 47 |
| display device of the breaking control device | 47a |
| input device of the breaking control device | 47b |
| WIS apparatus housing | 48 |
| locking device | 49 |
| sensor for locking device | 49a |
| kinematics link | 49b |
| engagement device | 49c |
| abutment element | 49c1 |
| abutment element | 49c2 |
| locking control device | 51 |
| display device of the locking control device | 51a |
| input device of the locking control device | 51b |
| Mechanical interfaces | 52 |
| housing base | 54 |
| projection camera | 56 |
| projection surface | 58 |
| position of watch interaction member support | A |
| position of watch interaction member support | B |

-continued

| Reference numeral list | |
|---|---|
| position of watch interaction member | I |
| position of watch interaction member | II |
| watch interaction member in form of winding crown (FIG. 10) | 60 |
| watch interaction member in form of start pusher (FIG. 10) | 62 |
| watch interaction member in form of stop pusher (FIG. 10) | 64 |
| Bracelet (watchstrap) of WIS system | 66 |
| movement of WIS system | 68 |
| big/hour watch hand of WIS system | 70 |
| small/minute watch hand of WIS system | 72 |
| calendar work/date display of WIS system | 74 |
| sweep second hand of WIS system | 76 |
| breaking device | 78 |
| locking device | 80 |

The invention claimed is:

1. Watch interaction simulation apparatus for simulating/mimicking a behavior of a watch interaction member during interaction of a user with the watch interaction member, the apparatus comprising:

(a) the watch interaction member adapted to receive input from the user and to provide output perceptible for the user;

(b) a watch interaction member support for the watch interaction member, wherein the watch interaction member is coupled to the watch interaction member support, wherein a coupling of the watch interaction member to the watch interaction member support is adapted to allow interaction of the user with the watch interaction member in relation to the watch interaction member support;

(c) a sensor device coupled with the watch interaction member and being adapted to sense an input from the user to the watch interaction member, and adapted to output sensor information indicating the sensed interaction;

(d) an actuator device being adapted to be coupled to the watch interaction member, the actuator device being adapted to generate, as actuator device output, at least one of a force, torque, translational movement and a rotational movement onto the watch interaction member, the coupling of the actuator device and the watch interaction member being adapted to transmit the actuator device output to the watch interaction member, whereby the watch interaction member provides an output of the watch interaction member perceptible for the user;

(e) an actuator control device being adapted to control the actuator device; and (f) a sensor information computing device being operatively coupled to the sensor device, the sensor information computing device being adapted to receive, from the sensor device, the sensor information indicating the sensed interaction and compute the received sensor information, wherein the actuator control device is adapted to control the actuator device on the basis of the computed sensor information.

2. The apparatus according to claim 1, wherein each of at least one of the actuator control device and the sensor information computing device comprises at least one of a physical user interface being adapted to receive control input from the user, a virtual user interface being adapted to receive control input from the user, a display device being the adapted to provide visual information to the user.

3. The apparatus according to the claim 1, further comprising:

a transducer device being adapted to be coupled to at least one of the watch interaction member and the watch interaction member support, the transducer device being adapted to generate, as transducer device output, at least one of mechanical, vibrational, haptic, tactile, acoustic and thermal energy, the coupling of the transducer device being adapted to transmit the transducer device output to the respective one of the watch interaction member and the watch interaction member support; and a transducer control device being adapted to control the transducer device.

4. The apparatus according to claim 1, further comprising a transmission device being adapted to be at least one of coupled between the actuator device and the watch interaction member, the coupling being adapted to transmit the actuator device output to the watch interaction member, coupled between, on the one hand, the actuator device and a further actuator device and, on the other hand, the watch interaction member and a further watch interaction member, the coupling being adapted to transmit the actuator device outputs to the watch interaction members, coupled between the transducer device and at least one of the watch interaction member and watch interaction member support, the coupling being adapted to transmit the transducer device output to the respective one of the watch interaction member and the watch interaction member support.

5. The apparatus according to claim 1, wherein the actuator device comprises at least one of:

an electrical actuator,
a magnetic actuator,
an electro-magnetic actuator,
a voice coil actuator,
a moving magnet actuator,
a piezoelectric actuator,
a hydraulic actuator,
a pneumatic actuator;

the actuator device provides at least one of the following actuator device outputs:

a position,
a translational movement,
a rotational movement,
a translational velocity,
a rotational velocity,
a translational acceleration,
a rotational acceleration,
a force,
a torque;

the sensor device comprises at least one of the following:

a position sensor,
a relative displacement sensor,
a translational movement sensor,
a rotational movement sensor,
a translational velocity sensor,
a rotational velocity sensor,
a translational acceleration sensor,
a rotational acceleration sensor,
a force sensor,
a torque sensor;

the sensor device comprises at least one of the following:

a capacitive sensor,
an inductive sensor,
a piezoelectric sensor,
a strain gage sensor,
an optical sensor,
a fiber-based sensor,
a laser sensor,
a magnetic sensor.

6. The apparatus according to claim 1, further comprising a display device being adapted to provide visual output mimicking visual information a watch can provide.

7. The apparatus according to claim 1, further comprising at least one of:

a breaking device being adapted to exert break force and/or moment onto the watch interaction member, wherein the breaking device is coupled with at least one of:

the actuator to exert breaking force onto the actuator,
the transmission device to exert breaking force onto the transmission device,
the watch interaction member to exert breaking force onto the watch interaction member;

a locking device being adapted to lock movements of the watch interaction member, wherein the locking device is coupled with at least one of:

the actuator to exert locking force onto the actuator,
the transmission device to exert locking force onto the transmission device,
the watch interaction member to exert locking force onto the watch interaction member.

8. The apparatus according to claim 1, wherein the watch interaction member is at least one of:

a winding crown,
a pusher,
a button,
a slider,
an input device being adapted to receive at least one of mechanical, vibrational, haptic, tactile, acoustic and thermal energy from the user,
an output device being adapted to provide at least one of mechanical, vibrational, haptic, tactile, acoustic and thermal energy to the user,
a bezel,
a bracelet,
a pusher of a bracelet.

9. The apparatus according to claim 1, further comprising a virtual reality device, the virtual reality device being adapted to immerse the user into a virtual environment mimicking a real-life situation including a watch.

10. A method of operating the apparatus according to claim 1, comprising steps to carry out steps to be performed by the apparatus.

11. A method of operating the apparatus according to claim 1, comprising:

sensing an input of the user to the watch interaction member;

outputting, by means of the sensor device, sensor information indicating the sensed input, receiving, by means of the sensor information computing device, the sensor information from the sensor device;

computing, by means of the sensor information computing device, the received sensor information;

controlling, by means of the actuator controlling device, the actuator device on the basis of the computed sensor information to generate, by means of the actuator device, the actuator device output; and transmitting the actuator device output to the watch interaction member to provide an output of the watch interaction member perceptible for the user.

12. Computer software product including executable software code being stored on a computer-readable medium and, when being executed by means of a computing device, carrying out the steps of the method according to claim 10.

13. Computer software product including executable software code being stored on a computer-readable medium and, when being executed by means of a computing device, carrying out the steps of the method according to claim 11.

14. The apparatus according to claim 4, wherein the transmission device comprises a parallel kinematics arrangement.

* * * * *